US009103571B2

(12) United States Patent
Yang et al.

(10) Patent No.: US 9,103,571 B2
(45) Date of Patent: Aug. 11, 2015

(54) REFRIGERATION APPARATUS

(71) Applicant: DAIKIN INDUSTRIES, LTD., Osaka-shi, Osaka (JP)

(72) Inventors: Guozhong Yang, Sakai (JP); Tetsuya Okamoto, Sakai (JP); Ikuhiro Iwata, Sakai (JP); Kazuhiro Furusho, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/388,804

(22) PCT Filed: Mar. 27, 2013

(86) PCT No.: PCT/JP2013/058969

§ 371 (c)(1),
(2) Date: Sep. 26, 2014

(87) PCT Pub. No.: WO2013/146870

PCT Pub. Date: Oct. 3, 2013

(65) Prior Publication Data

US 2015/0052927 A1 Feb. 26, 2015

(30) Foreign Application Priority Data

Mar. 30, 2012 (JP) ..... 2012-081361

(51) Int. Cl.
*F25B 1/10* (2006.01)
*F25B 29/00* (2006.01)
(Continued)

(52) U.S. Cl.
CPC ..... *F25B 29/003* (2013.01); *F25B 1/10* (2013.01); *F25B 13/00* (2013.01); *F25B 30/02* (2013.01);
(Continued)

(58) Field of Classification Search
USPC ..... 62/84, 149, 159, 193, 192, 196.1, 62/196.2, 196.3, 324.6, 468, 470, 472, 510
See application file for complete search history.

(56) References Cited

U.S. PATENT DOCUMENTS

2005/0103045 A1* 5/2005 Matsuoka et al. ..... 62/498
2009/0314017 A1* 12/2009 Nishimura et al. ..... 62/149

FOREIGN PATENT DOCUMENTS

EP 2 230 472 A1 11/2008
JP 2001108195 A * 4/2001 ..... F02M 21/02
(Continued)

OTHER PUBLICATIONS

International Preliminary Report of corresponding PCT Application No. PCT/JP2013/058969 dated Oct. 9, 2014.
(Continued)

*Primary Examiner* — Frantz Jules
*Assistant Examiner* — Emmanuel Duke
(74) *Attorney, Agent, or Firm* — Global IP Counselors

(57) ABSTRACT

A refrigeration apparatus includes a multistage compression mechanism, a heat-source-side main heat exchanger, at least one heat-source-side sub heat exchanger, a usage-side heat exchanger, a switching mechanism, an expansion mechanism and a refrigerant piping group. The refrigerant piping group connects the multistage compression mechanism, the switching mechanism, the heat-source-side main heat exchanger, the heat-source-side sub heat exchanger, the expansion mechanism and the usage-side heat exchanger so that during the heating operation, the heat-source-side main heat exchanger and the heat-source-side sub heat exchanger are connected in series.

11 Claims, 9 Drawing Sheets

(51) Int. Cl.

| | |
|---|---|
| ***F25B 13/00*** | (2006.01) |
| ***F25B 30/02*** | (2006.01) |
| *F25B 9/00* | (2006.01) |
| *F25B 11/02* | (2006.01) |
| *F25B 40/00* | (2006.01) |

(52) U.S. Cl.
CPC ..... *F25B 9/008* (2013.01); *F25B 11/02* (2013.01); *F25B 40/00* (2013.01); *F25B 2309/061* (2013.01); *F25B 2313/0233* (2013.01); *F25B 2313/0272* (2013.01); *F25B 2313/02741* (2013.01); *F25B 2341/0661* (2013.01); *F25B 2400/072* (2013.01); *F25B 2400/13* (2013.01)

(56) References Cited

FOREIGN PATENT DOCUMENTS

| | | | | | |
|---|---|---|---|---|---|
| JP | 2005040626 | A | * | 9/2005 | ..... F04B 49/06 |
| JP | 2010-112618 | A | | 5/2010 | |
| JP | 2010-156493 | A | | 7/2010 | |
| WO | 2008/057090 | A1 | | 5/2008 | |

OTHER PUBLICATIONS

International Search Report of corresponding PCT Application No. 2013/058969 dated May 14, 2013.
European Search Report of corresponding EP Application No. 13 76 8628.3 dated Mar. 17, 2015.

* cited by examiner

REFRIGERATION APPARATUS

CROSS-REFERENCE TO RELATED APPLICATIONS

This U.S. National stage application claims priority under 35 U.S.C. §119(a) to Japanese Patent Application No. 2012-081361, filed in Japan on Mar. 27, 2012, the entire contents of which are hereby incorporated herein by reference.

TECHNICAL FIELD

The present invention relates to a refrigeration apparatus especially provided with a multistage compression mechanism having a plurality of compression parts.

BACKGROUND ART

There is conventionally used a refrigeration apparatus that carries out a multistage compression refrigeration cycle, being a refrigeration apparatus provided with means for cooling intermediate-pressure refrigerant in the course of compression. The refrigeration apparatus described in Japanese Laid-open Patent Application No. 2010-112618 has a heat source unit provided with an outdoor-side heat exchanger and an outdoor-side intermediate cooler. In the cooling operation, the outdoor-side heat exchanger functions as a gas cooler, and the outdoor-side intermediate cooler functions as an intercooler that cools intermediate-pressure refrigerant discharged from a preceding stage compression element and sucked into a subsequent stage compression element. Improved operating efficiency is realized in this refrigeration apparatus as intermediate-pressure refrigerant is cooled in the course of compression.

SUMMARY

Technical Problem

In the refrigeration apparatus described in Japanese Laid-open Patent Application No. 2010-112618, during the heating operation, gas-liquid two-phase refrigerant depressurized by an expansion mechanism is distributed to flow in parallel through both the outdoor-side heat exchanger and the outdoor-side intermediate cooler, the outdoor-side heat exchanger and the outdoor-side intermediate cooler being made to function as evaporators. In comparison to the case of using only the outdoor-side heat exchanger as an evaporator, this arrangement enables an increase in the volume of refrigerant circulated and realizes a refrigeration apparatus with improved operating efficiency.

However, in the case of performing three or more compression stages, when there are a plurality of sub heat-source-side heat exchangers functioning as intercoolers, because there are differences in pressure in the refrigerant flowing in the cooling operation in each of the heat-source-side heat exchangers, in a design that emphasises performance in the cooling operation, there are concerns that the quantity of refrigerant flowing in each of the heat-source-side heat exchangers in the heating operation may diverge substantially from the correct value. In other words, the concern is that in the heating operation, uneven flow of refrigerant may occur, most of the refrigerant flow into only heat-source-side heat exchangers having low-pressure loss, and each of the heat-source-side heat exchangers does not function adequately as evaporators.

This problem of uneven flow of refrigerant occurring in the plurality of heat-source-side heat exchangers in which the refrigerant flows in parallel during the heating operation can be handled by an adjustment of the flow distribution using an electronic valve or a capillary tube. But the adjustment of the flow distribution cannot handle the problem when there is a substantial difference in pressure loss among the heat-source-side heat exchangers.

An object of the present invention is to provide a refrigeration apparatus that performs multistage compression, being provided with a plurality of heat-source-side heat exchangers that function as evaporators in the heating operation, in which uneven flow of refrigerant can be easily suppressed.

Solution to Problem

A refrigeration apparatus according to a first aspect of the present invention is provided with a multistage compression mechanism, a heat-source-side main heat exchanger, a plurality of heat-source-side sub heat exchangers, a usage-side heat exchanger, switching mechanisms, an expansion mechanism, and a refrigerant piping group. The multistage compression mechanism is a compression mechanism in which one low-stage compression part and a plurality of high-stage compression parts are respectively connected in series. The heat-source-side main heat exchanger functions as a radiator during the cooling operation, and functions as an evaporator during the heating operation. The heat-source-side sub heat exchangers function, during the cooling operation, as radiators that cool intermediate-pressure refrigerant in the course of compression that is taken into the high-stage compression parts, and function as evaporators during the heating operation. The usage-side heat exchanger functions as an evaporator during the cooling operation and functions as a radiator during the heating operation. The switching mechanisms change conditions so that during the cooling operation the refrigerant is delivered from the heat-source-side main heat exchanger to the usage-side heat exchanger, and during the heating operation, the refrigerant is delivered from the usage-side heat exchanger to the heat-source-side main heat exchanger and the heat-source-side sub heat exchangers. The expansion mechanism, during the cooling operation, depressurizes the refrigerant delivered from the heat-source-side main heat exchanger to the usage-side heat exchanger, and during the heating operation, depressurizes the refrigerant delivered from the usage-side heat exchanger to the heat-source-side main heat exchanger and the heat-source-side sub heat exchangers. The refrigerant piping group, connects the multistage compression mechanism, the switching mechanisms, the heat-source-side main heat exchanger, the heat-source-side sub heat exchangers, the expansion mechanism and the usage-side heat exchanger, so that during the heating operation, the refrigerant flows in series to not less than two of the heat-source-side sub heat exchangers from among the plurality of heat-source-side sub heat exchangers. In this refrigeration apparatus, during the cooling operation, the refrigerant flowing from the heat-source-side main heat exchanger functioning as a radiator to the usage-side heat exchanger functioning as an evaporator, is decompressed in the expansion mechanism, and in the multistage compression mechanism, intermediate-pressure refrigerant in the course of compression that is taken into the plurality of high-stage compression parts is cooled by the plurality of heat-source-side sub heat exchangers. Further, during the heating operation, the refrigerant that flows from the usage-side heat exchanger functioning as a radiator, to the heat-source-side main heat exchanger and the heat-source-side sub heat exchangers functioning as evaporators is decompressed in the expansion mechanism, and the refrigerant after decompression flows to the heat-source-side main heat exchanger and also to not less than two of the heat-source-side sub heat exchangers that are connected in series by the refrigerant piping group, and evaporates in the heat-source-side main heat exchanger and these heat-source-side sub heat exchangers. That is to say, each of the plurality of heat-source-side sub heat exchangers, during the cooling operation, functions as radiators for the refrigerant drawn in to the high-stage compression parts, and functions as evaporators, during the heating operation, not less than two are connected in series. Adopting this configuration means that even in the case of a heat-source-side sub heat exchanger is designed to emphasise performance for the cooling operation, it becomes possible for the quantity of the refrigerant flowing respectively to the heat-source-side main heat exchanger and the heat-source-side sub heat exchangers during the heating operation to approach the appropriate value, enabling suppression of uneven flow of refrigerant in each of the heat exchangers of the heat-source-side.

A refrigeration apparatus according to a second aspect of the present invention is the refrigeration apparatus according to the first aspect of the present invention, in which the plurality of high-stage compression parts are a second stage compression part, a third stage compression part, and a fourth stage compression part. The second stage compression part takes in the refrigerant blown out from the low-stage compression part. The third stage compression part takes in the refrigerant blown out from the second stage compression part. The fourth stage compression part takes in the refrigerant blown out from the third stage compression part, and blows out the refrigerant to the radiator. The plurality of heat-source-side sub heat exchangers are a heat-source-side first sub heat exchanger, a heat-source-side second sub heat exchanger, and a heat-source-side third sub heat exchanger. The heat-source-side first sub heat exchanger, during the cooling operation, cools the refrigerant blown out from the low-stage compression part and taken into the second stage compression part. The heat-source-side second sub heat exchanger, during the cooling operation, cools the refrigerant blown out from the second stage compression part and taken into the third stage compression part. The heat-source-side third sub heat exchanger, during the cooling operation, cools the refrigerant blown out from the third stage compression part and taken into the fourth stage compression part. Moreover, during the heating operation, the refrigerant flows in series to the heat-source-side first sub heat exchanger and the heat-source-side second sub heat exchanger, or flows in series to the heat-source-side first sub heat exchanger, the heat-source-side second sub heat exchanger and the heat-source-side third sub heat exchanger.

In this refrigeration apparatus, during the cooling operation, the three heat-source-side sub heat exchangers cool respectively the refrigerant taken into the second stage compression part, the refrigerant taken into the third stage compression part, and the refrigerant taken into the fourth stage compression part. On the other hand, during the heating operation, the refrigerant flows in series to two heat exchangers, being the heat-source-side first sub heat exchanger and the heat-source-side second sub heat exchanger, or flows in series to three heat exchangers, being the heat-source-side first sub heat exchanger, the heat-source-side second sub heat exchanger and the heat-source-side third sub heat exchanger. In this way, uneven flow of the refrigerant to each of the heat exchangers on the heat-source-side can be suppressed.

In the case when the refrigerant flows in parallel to, the heat-source-side main heat exchanger, also the heat-source-side first sub heat exchanger and the heat-source-side second sub heat exchanger connected in series, as well as the heat-source-side third sub heat exchanger, when the degrees of super heat after evaporation of the three-way distributed refrigerant flow can be brought to similar values, it is preferable that the refrigerant piping group is provided so that, during the heating operation, the refrigerant flows in series to the two heat exchangers, being the heat-source-side first sub heat exchanger and the heat-source-side second sub heat exchanger.

Further, in the case when the refrigerant flows in parallel to, the heat-source-side main heat exchanger, and the heat-source-side first sub heat exchanger, heat-source-side second sub heat exchanger and heat-source-side third sub heat exchanger that are connected in series, when the degrees of super heat after evaporation of the two-way distributed refrigerant flow can be brought to similar values, it is preferable that the refrigerant piping group is provided so that, during the heating operation, the refrigerant flows in series to the three heat exchangers, being the heat-source-side first sub heat exchanger, the heat-source-side second sub heat exchanger and the heat-source-side third sub heat exchanger. That is to say, the refrigeration apparatus according to a third aspect of the present invention is the refrigeration apparatus according to the second aspect, in which, during the heating operation, the refrigerant delivered from the usage-side heat exchanger via the expansion mechanism flows in parallel, the flow being distributed along the three channels of the heat-source-side first sub heat exchanger and heat-source-side second sub heat exchanger connected in series, the heat-source-side main heat exchanger, and the heat-source-side third sub heat exchanger.

A refrigeration apparatus according to a fourth aspect of the present invention is the refrigeration apparatus according to any of the first through third aspects, in which the plurality of heat-source-side sub heat exchangers in which the refrigerant flows in series during the heating operation are connected in series, during the heating operation, via the switching mechanisms.

Here, by using a switching mechanism which changes a condition so as to change the direction of refrigerant flow during the cooling operation and the heating operation, the refrigerant piping group operates connection of each of devices and mechanisms so that the refrigerant flows in series to not less than two of the heat-source-side sub heat exchangers during the heating operation, thus reducing a production cost of a refrigerant apparatus.

A refrigeration apparatus according to a fifth aspect of the present invention is the refrigeration apparatus according to any of the first through fourth aspects, in which during the heating operation, not less than two heat-source-side sub heat exchangers from among the plurality of heat-source-side sub heat exchangers are connected in series with the heat-source-side main heat exchanger, and the refrigerant flows in series to not less than two heat-source-side sub heat exchangers from among the plurality of heat-source-side sub heat exchangers and the heat-source-side main heat exchanger.

Here, it is not simply that during the heating operation not less than two of the heat-source-side sub heat exchangers are connected in series, but it is that additionally, the heat-source-side main heat exchanger is connected to those not less than two heat-source-side sub heat exchangers connected in series. In this way, even though in the case in which, pressure loss is small in a number of heat-source-side sub heat exchangers, and it is difficult to adjust uneven flow when refrigerant flows in parallel to those heat-source-side sub heat exchangers and the heat-source-side main heat exchanger, by connecting all of these in series when flowing refrigerant during the heating operation, uneven flow to be can be suppressed.

Moreover, the refrigeration apparatus according to this fifth aspect includes a refrigeration apparatus in which a refrigerant piping group is provided so that during the heating operation, refrigerant flows through the heat exchangers with all of the heat exchangers from among the plurality of heat-source-side sub heat exchangers and the heat-source-side main heat exchanger being connected in series.

A refrigeration apparatus according to a sixth aspect of the present invention is provided with a multistage compression mechanism, a heat-source-side main heat exchanger, heat-source-side sub heat exchangers, a usage-side heat exchanger, switching mechanisms, an expansion mechanism, and a refrigerant piping group. The multistage compression mechanism is a compression mechanism in which a low-stage compression part and a high-stage compression part are connected in series. The heat-source-side main heat exchanger functions as a radiator during the cooling operation, and functions as an evaporator during the heating operation. The heat-source-side sub heat exchanger functions, during the cooling operation, as a radiator that cools intermediate-pressure refrigerant in the course of compression that is taken into the high-stage compression part, and functions as an evaporator during the heating operation. The usage-side heat exchanger functions as an evaporator during the cooling operation and functions as a radiator during the heating operation. The switching mechanism changes conditions so that during the cooling operation, the refrigerant is delivered from the heat-source-side main heat exchanger to the usage-side heat exchanger, and during the heating operation, the refrigerant is delivered from the usage-side heat exchanger to the heat-source-side main heat exchanger and the heat-source-side sub heat exchanger. The expansion mechanism, during the cooling operation, depressurizes the refrigerant delivered from the heat-source-side main heat exchanger to the usage-side heat exchanger, and during the heating operation, depressurizes the refrigerant delivered from the usage-side heat exchanger to the heat-source-side main heat exchanger and the heat-source-side sub heat exchanger. The refrigerant piping group, connects the multistage compression mechanism, the switching mechanism, the heat-source-side main heat exchanger, the heat-source-side sub heat exchanger, the expansion mechanism and the usage-side heat exchanger, so that during the heating operation, the heat-source-side main heat exchanger and the heat-source-side sub heat exchanger are connected in series.

With the refrigeration apparatus described in Patent Literature 1 (Japanese Laid-open Patent Application No. 2010-112618), during the heating operation, gas-liquid two-phase refrigerant depressurized by an expansion mechanism is distributed to flow in parallel through both a heat-source-side main heat exchanger (outdoor-side heat exchanger) and a heat-source-side sub heat exchanger (outdoor-side intermediate cooler), the heat-source-side main heat exchanger and heat-source-side sub heat exchanger being made to function as evaporators.

However, because of the differences in the respective functioning of the heat-source-side main heat exchanger that functions as a gas cooler of high pressure refrigerant during the cooling operation, and the heat-source-side sub heat exchanger that functions as an intercooler of intermediate-pressure refrigerant during the cooling operation, in this design there is a substantial difference in pressure loss of refrigerant in the heat exchangers. Accordingly, in a design that emphasises function during the cooling operation, there is concern that the quantities of the refrigerant flowing to the heat-source-side main heat exchanger and the heat-source-side sub heat exchanger during the heating operation, may diverge substantially from the appropriate values.

Compared with this, in the refrigeration apparatus according to the sixth aspect of the present invention, during the cooling operation, the heat-source-side main heat exchanger functions as a radiator for the refrigerant blown out from the multistage compression mechanism, and the heat-source-side sub heat exchanger functions as a radiator for cooling intermediate-pressure refrigerant in the course of compression that is taken into the high-stage compression part. In the meantime, during the heating operation, both the heat-source-side main heat exchanger and heat-source-side sub heat exchanger function as evaporators. Moreover, a refrigerant piping group is provided so that during the heating operation, the heat-source-side main heat exchanger and the heat-source-side sub heat exchanger that together function as evaporators during the heating operation are connected in series. Adopting this configuration in which during the heating operation the same refrigerant flows to the heat-source-side main heat exchanger and the heat-source-side sub heat exchanger connected in series, means that even in the case of a design that emphasises performance of the heat-source-side main heat exchanger and the heat-source-side sub heat exchanger during the cooling operation, the phenomenon of uneven flow of the refrigerant during the heating operation is suppressed.

Advantageous Effects of Invention

In the refrigeration apparatus according to the first aspect of the present invention, even in the case of a design of the heat-source-side sub heat exchangers that emphasises performance for the cooling operation, it becomes possible for the quantity of refrigerant flowing respectively to the heat-source-side main heat exchanger and the heat-source-side sub heat exchangers in the heating operation, to approach the appropriate value, enabling suppression of uneven flow of refrigerant in each of the heat exchangers on the heat-source-side.

In the refrigeration apparatus according to the second and third aspects of the present invention, the refrigerant flows in series to both the heat-source-side first sub heat exchanger and the heat-source-side second sub heat exchanger, or, the refrigerant flows in series to the three heat exchangers, the heat-source-side first sub heat exchanger, the heat-source-side second sub heat exchanger, and the heat-source-side third sub heat exchanger, thus uneven flow of refrigerant in each of the heat exchangers on the heat-source-side can be suppressed.

The refrigeration apparatus according to the fourth aspect of the present invention uses the switching mechanism that switches between cooling and heating, and in the heating operation, refrigerant flows in series to not less than two heat-source-side sub heat exchangers. This enables the cost of production of the refrigeration apparatus to be reduced.

In the refrigeration apparatus according to the fifth aspect of the present invention, as there is a heat-source-side main heat exchanger further connected to not less than two heat-source-side sub heat exchangers connected in series, even in the case of there being a substantial difference in pressure loss in each of the heat source exchangers on the heat-source-side, uneven flow of refrigerant can be suppressed.

In the refrigeration apparatus according to the sixth aspect of the present invention, even in the case of a design for each heat exchanger on the heat-source-side that emphasises performance for the cooling operation, the phenomenon of uneven flow of refrigerant in the heating operation can be suppressed.

DESCRIPTION OF EMBODIMENTS

An air-conditioning apparatus 10, being a refrigeration apparatus according to an embodiment of the present invention, will now be described with reference to the drawings.

(1) Configuration of the Air-Conditioning Apparatus

Figure 1:
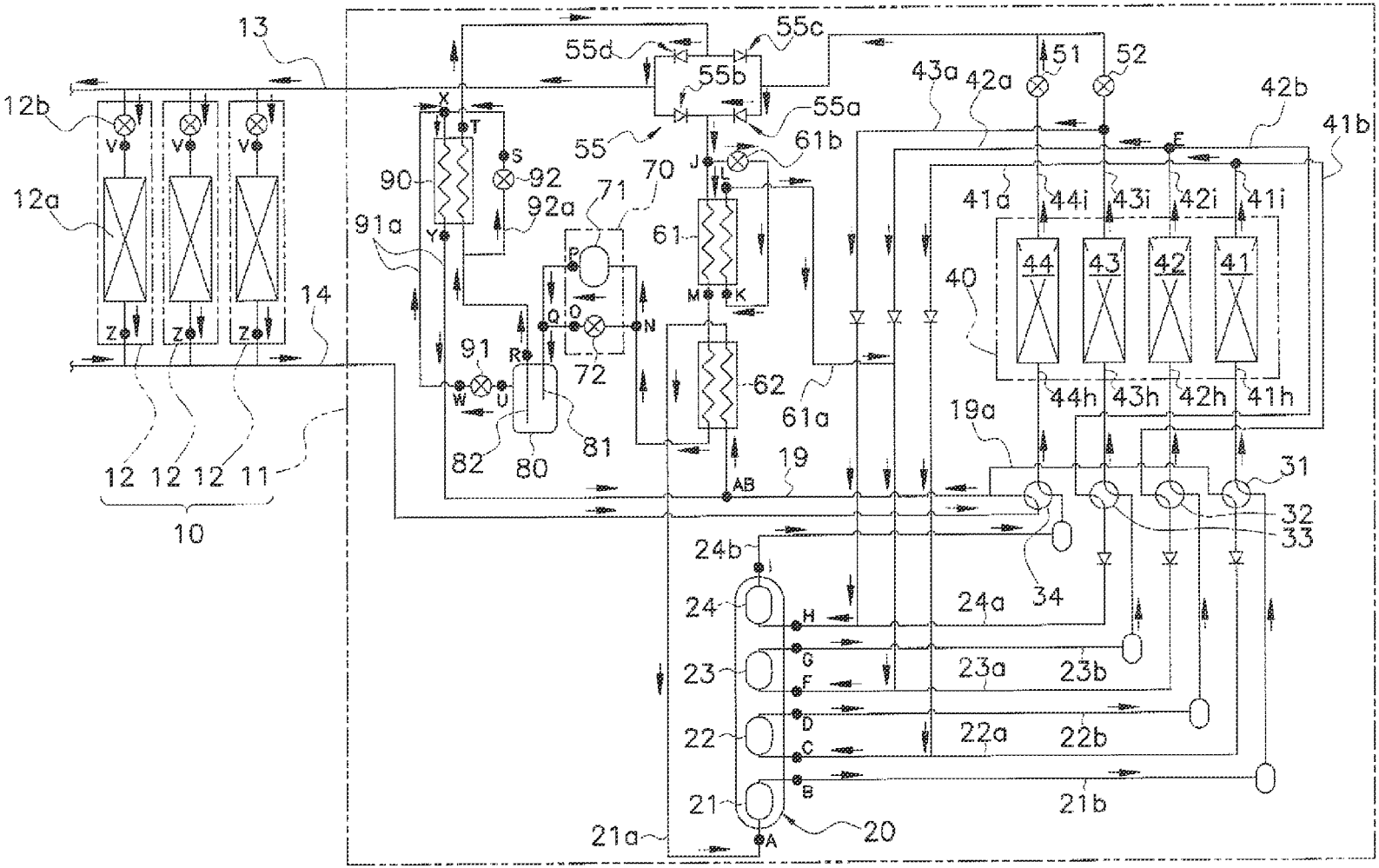
FIG. 1 is a schematic structural diagram for the cooling operation of an air-conditioning apparatus according to an embodiment of the present invention.
Figure 3:
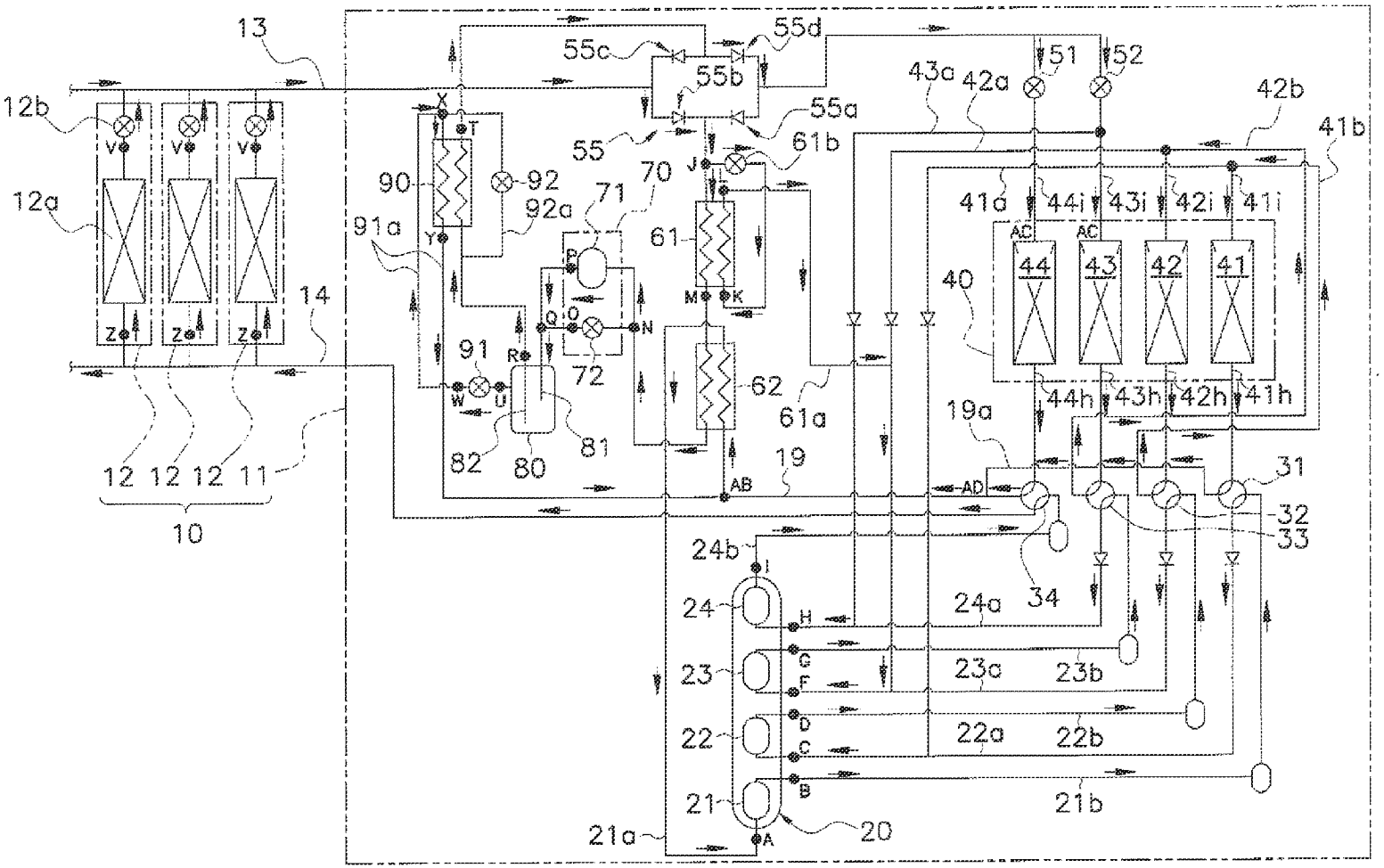
FIG. 3 is a schematic structural diagram for the heating operation of the air-conditioning apparatus.

FIGS. 1 and 3 are schematic structural diagrams of the air-conditioning apparatus 10. The air-conditioning apparatus 10 is a refrigeration apparatus that performs a four-stage compression refrigeration cycle using carbon dioxide refrigerant in the supercritical state. The air-conditioning apparatus 10 is a refrigeration apparatus in which an outdoor unit 11 that is a heat source unit, and a plurality of indoor units 12 that are usage units, are connected via connecting refrigerant pipes 13 and 14, and the apparatus having a refrigerant circuit that switches between the cooling operation cycle and the heating operation cycle. FIG. 1 shows the flow of refrigerant circulating in the refrigerant circuit in the cooling operation. FIG. 3 shows the flow of refrigerant circulating in the refrigerant circuit in the heating operation. In FIG. 1 and FIG. 3, the arrows shown along the refrigerant pipes of the refrigerant circuit represent the flow of refrigerant.

Figure 5:
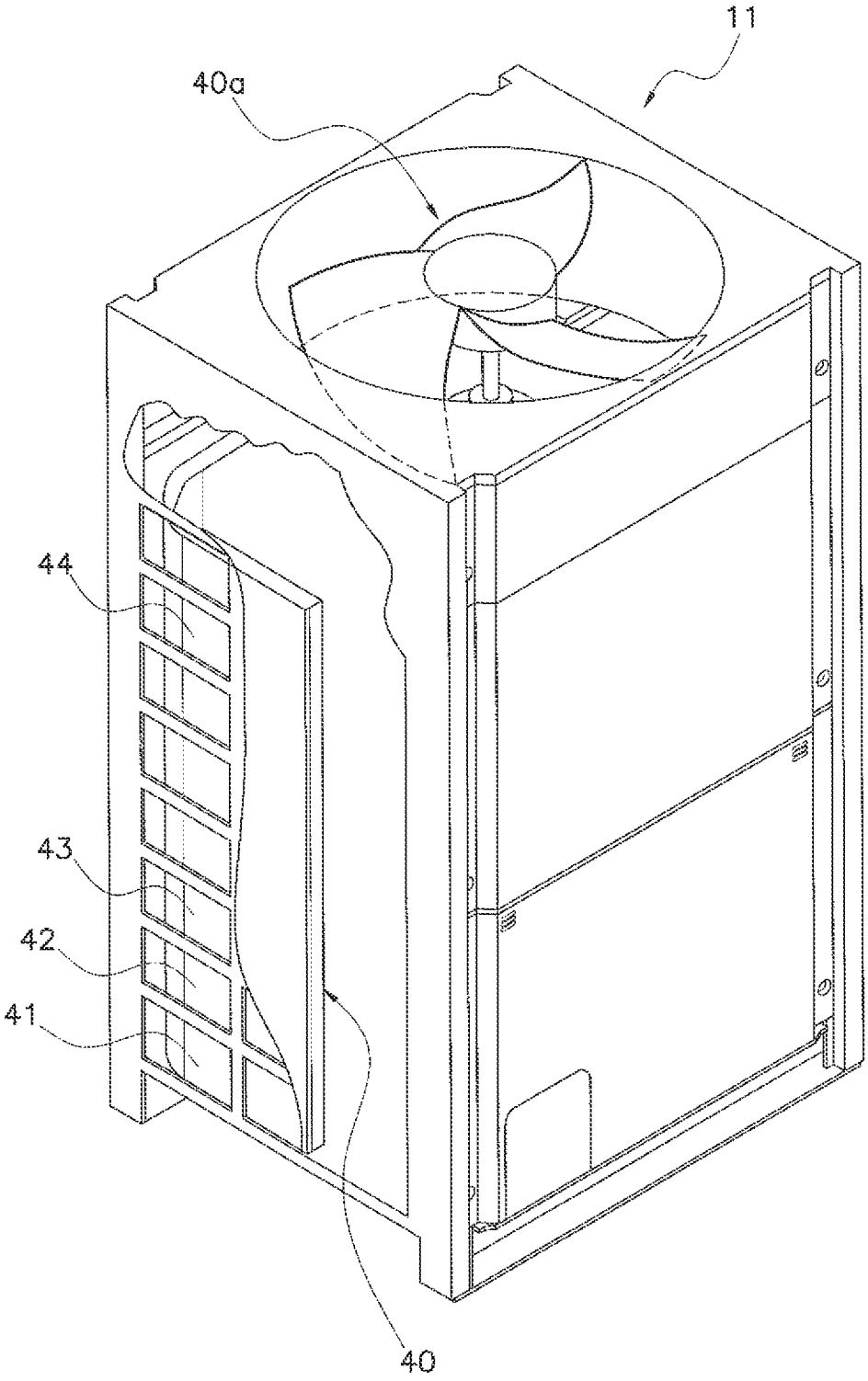
FIG. 5 is a schematic perspective view of the air-conditioning apparatus that omits some of the side plate of the outdoor unit.

The refrigerant circuit of the air-conditioning apparatus 10 includes mainly a four-stage compressor 20, first through fourth switching mechanisms 31-34, an outdoor heat exchanger 40, first and second outdoor electronic expansion valves 51 and 52, a bridge circuit 55, an economizer heat exchanger 61, an internal heat exchanger 62, an expansion mechanism 70, a receiver 80, a super-cooling heat exchanger 90, an indoor heat exchanger 12*a*, an indoor electronic expansion valve 12*b* and a refrigerant piping group connecting these devices and valves. As shown in FIG. 5, the outdoor heat exchanger 40 includes, vertically arranged, a first heat exchanger 41, a second heat exchanger 42, a third heat exchanger 43, and a fourth heat exchanger 44.

The constituents of the refrigerant circuit will now be described in detail.

(1-1) Four-Stage Compressor

The four-stage compressor 20 is a sealed-type compressor in which a first compression part 21, a second compression part 22, a third compression part 23, a fourth compression part 24, and a compressor drive motor (not illustrated) are housed inside a sealed container. The compressor drive motor drives the four compression parts 21 through 24 via a drive shaft. That is, the four-stage compressor 20 has a uniaxial four-stage compression structure in which the four compression parts 21 to 24 are coupled to a single drive shaft. In the four-stage compressor 20, the first compression part 21, the second compression part 22, the third compression part 23, and the fourth compression part 24 are connected via pipes in series in that order. The first compression part 21 sucks in refrigerant from a first intake pipe 21*a* and blows out refrigerant to a first blow-out pipe 21 *b*. The second compression part 22 sucks in refrigerant from a second intake pipe 22*a* and blows out refrigerant to a second blow-out pipe 22*b*. The third compression part 23 sucks in refrigerant from a third intake pipe 23*a* and blows out refrigerant from a third blow-out pipe 23*b*. The fourth compression part 24 sucks in refrigerant from a fourth intake pipe 24*a* and blows out refrigerant to a fourth blow-out pipe 24*b*.

The first compression part 21 is the compression mechanism at the lowest stage, and compresses the refrigerant having the lowest pressure flowing in the refrigerant circuit. The second compression part 22 sucks in and compresses the refrigerant compressed by the first compression part 21. The third compression part 23 sucks in and compresses the refrigerant compressed by the second compression part 22. The fourth compression part 24 is the compression mechanism at the highest stage, which sucks in and compresses the refrigerant compressed by the third compression part 23. The refrigerant compressed by the fourth compression part 24 and blown out to the fourth blow-out pipe 24*b* is the refrigerant having the highest pressure flowing in the refrigerant circuit.

In the present embodiment, the compression parts 21 to 24 are positive displacement type compression mechanisms, such as rotary-type or scroll type. The compressor drive motor is controlled by an inverter via a control unit.

An oil separator is disposed in each of the first blow-out pipe 21*b*, the second blow-out pipe 22*b*, the third blow-out pipe 23*b*, and the fourth blow-out pipe 24*b*. The oil separator is a small container for separating lubricating oil contained in the refrigerant circulating in the refrigerant circuit. Although omitted in FIG. 1, an oil return pipe that includes a capillary tube extends from below each oil separator towards each of the intake pipes 21*a*-24*a*, returning the oil separated from the refrigerant to the four-stage compressor 20.

Further, a check valve for stopping flow of refrigerant towards the first switching mechanism 31 is disposed in the second intake pipe 22*a*, a check valve for stopping flow of refrigerant towards the second switching mechanism 32 is disposed in the third intake pipe 23*a*, and a check valve for stopping flow of refrigerant towards the third switching mechanism 33 is disposed in the fourth intake pipe 24*a*.

(1-2) First to Fourth Switching Mechanisms

The first switching mechanism 31, second switching mechanism 32, third switching mechanism 33, and fourth switching mechanism 34 are each four-way switching valves for switching the direction of flow of the refrigerant in the refrigerant circuit, to switch between the cooling operation cycle and the heating operation cycle.

The four ports of the first switching mechanism 31 are connected to the first blow-out pipe 21*b*, the second intake pipe 22*a*, a high-temperature-side pipe 41*h* of the first heat exchanger 41 and a branch pipe 19*a* of a low-pressure refrigerant pipe 19. The low-pressure refrigerant pipe 19 is a refrigerant pipe in which low-pressure gas refrigerant inside the outdoor unit 11 flows, and sends refrigerant via the internal heat exchanger 62 to the first intake pipe 21*a*. The branch pipe 19*a* is a pipe that couples the first switching mechanism 31 and the low-pressure refrigerant pipe 19.

The four ports of the second switching mechanism 32 are connected to the second blow-out pipe 22*b*, the third intake pipe 23*a*, a high-temperature-side pipe 42*h* of the second heat exchanger 42 and a serial connection first pipe 41*b*. The serial connection first pipe 41*b* couples the second switching mechanism 32 and a low-temperature-side pipe 41*i* of the first heat exchanger 41.

The four ports of the third switching mechanism 33 are connected to the third blow-out pipe 23*b*, the fourth intake pipe 24*a*, a high-temperature-side pipe 43*h* of the third heat exchanger 43, and a serial connection second pipe 42*b*. The serial connection second pipe 42*b* couples the third switching mechanism 33 and a low-temperature-side pipe 42*i* of the second heat exchanger 42.

The four ports of the fourth switching mechanism 34 are connected to the fourth blow-out pipe 24*b*, the connecting refrigerant pipe 14, the high-temperature-side pipe 44*h* of the fourth heat exchanger 44, and the low-pressure refrigerant pipe 19.

In the condition shown in FIG. 1, in the cooling operation, the switching mechanisms 31 to 34 enable the heat exchangers 41 through 44 to function as coolers of the refrigerant compressed by the four-stage compressor 20, and enable the indoor heat exchanger 12*a* to function as an evaporator (heater) of expanded refrigerant that passes through the expansion mechanism 70 and indoor electronic expansion valve 12*b*. In the heating operation, in the condition shown in FIG. 3, the switching mechanisms 31 to 34 enable the indoor heat exchanger 12*a* to function as a cooler (radiator) of expanded refrigerant compressed by the four-stage compressor 20, and enable the outdoor heat exchanger 40 to function as an evaporator of refrigerant that passes through the expansion mechanism 70 and the indoor outdoor electronic expansion valves 51 and 52.

That is, the switching mechanisms 31 through 34, focusing here only on the four-stage compressor 20, the outdoor heat exchanger 40, the expansion mechanism 70 and the indoor heat exchanger 12*a* comprising constituent elements of the refrigeration circuit, perform the role of switching between the cooling cycle in which refrigerant is circulated through, in order, the four-stage compressor 20, the outdoor heat exchanger 40, the expansion mechanism 70, and the indoor heat exchanger 12*a*, and the heating cycle in which refrigerant is circulated through, in order, the four-stage compressor 20, the indoor heat exchanger 12*a*, the expansion mechanism 70 and the outdoor heat exchanger 40.

(1-3) The Outdoor Heat Exchanger

As described above, the outdoor heat exchanger 40 comprises the first heat exchanger 41, the second heat exchanger 42, the third exchanger 43 and the fourth heat exchanger 44. In the cooling operation, the first through third heat exchangers 41-43 each function as intercoolers that cool refrigerant in the course of compression (intermediate-pressure refrigerant), while the fourth heat exchanger 44 functions as a gas cooler that cools refrigerant of the highest pressure. The fourth heat exchanger 44 has greater capacity than the first through third heat exchangers 41-43. Further, in the heating operation, the first through fourth heat exchangers 41-44 all function as evaporators (heaters) of low pressure refrigerant.

As shown in FIG. 5, the outdoor heat exchanger 40 comprises an integrated structure including, arranged in order from bottom to top, the first heat exchanger 41, the second heat exchanger 42, the third heat exchanger 43, and the fourth heat exchanger 44. Water or air is supplied to this outdoor heat exchanger 40 to provide the cooling source or heating source for performing heat exchange with the refrigerant flowing inside. In the outdoor heat exchanger 40, as a blower fan 40*a* shown in FIG. 5 blows air upward, external air is taken into the outdoor unit 11 from behind and the sides of the outdoor unit 11, passing through the outdoor heat exchanger 40. With the outdoor unit 11 so configured, a relatively substantial quantity of air passes through the fourth heat exchanger 44 positioned above, while a relatively smaller quantity of air passes through the first through third heat exchangers 41-43 positioned below.

Further, the branch pipes that are, a first intercooler pipe 41*a*, a second intercooler pipe 42*a*, and a third intercooler pipe 43*a*, extend respectively from the low-temperature-side pipe 41*i* of the first heat exchanger 41, the low-temperature-side pipe 42*i* of the second heat exchanger 42, and the low-temperature-side pipe 43*i* of the third heat exchanger 43, towards respectively the second intake pipe 22*a*, the third intake pipe 23*a* and the fourth intake pipe 24*a*. As shown in FIG. 1, a check valve is provided to each of the first intercooler pipe 41*a*, the second intercooler pipe 42*a* and the third intercooler pipe 43*a*.

(1-4) The First and Second Outdoor Electronic Expansion Valves

The first and second outdoor electronic expansion valves 51 and 52 are disposed between the outdoor heat exchanger 40 and the bridge circuit 55. Specifically, the first outdoor electronic expansion valve 51 is disposed between the fourth heat exchanger 44 and the bridge circuit 55, and the second outdoor electronic expansion valve 52 is disposed between the third heat exchanger 43 and the bridge circuit 55. In the heating operation, refrigerant flowing from the bridge circuit 55 to the outdoor heat exchanger 40 is branched into two flows, these being expanded in the first outdoor electronic expansion valve 51 and the second electronic expansion valve 52 respectively, and then flowing into the fourth heat exchanger 44 and the third heat exchanger 43 respectively.

In the cooling operation, the second outdoor electronic expansion valve 52 closes, while the first electronic expansion valve 51 is fully open. In the heating operation, the first and second outdoor electronic expansion valves 51 and 52 each operate as expansion mechanisms, the opening being adjusted to enable the appropriate quantity of refrigerant, (that avoids uneven flow) to flow into the fourth heat exchanger 44 and the third heat exchanger 43.

In addition, the third intercooler pipe 43*a* described above branches out from between the third heat exchanger 43 and the second outdoor electronic expansion valve 52.

(1-5) Bridge Circuit

The bridge circuit 55 is disposed between the outdoor heat exchanger 40 and the indoor heat exchanger 12*a*, and is connected to the intake pipe 81 of the receiver 80 via the economizer heat exchanger 61, the internal heat exchanger 62 and the expansion mechanism 70, and to the outlet pipe 82 of the receiver 80 via the super-cooling heat exchanger 90.

The bridge circuit 55 has four check valves, 55*a*, 55*b*, 55*c* and 55*d*. The intake check valve 55*a* is a check valve that allows only flow of refrigerant from the outdoor heat exchanger 40 to the intake pipe 81 of the receiver 80. The intake check valve 55*b* allows only flow of refrigerant from the indoor heat exchanger 12*a* to the intake pipe 81 of the receiver 80. The outlet check valve 55*c* allows only flow of refrigerant from the outlet pipe 82 of the receiver 80 to the outdoor heat exchanger 40. The outlet check valve 55*d* allows only flow of refrigerant from the outlet pipe 82 of the receiver 80 to the indoor heat exchanger 12*a*. That is, the intake check valves 55*a* and 55*b* fulfil the function of flowing refrigerant from either the outdoor heat exchanger 40 or the indoor heat exchanger 12*a* to the intake pipe 81 of the receiver 80, while the outlet check valves 55*c* and 55*d* fulfil the function of flowing refrigerant from the intake pipe 82 of the receiver 80 to the outdoor heat exchanger 40 and the indoor heat exchanger 12*a*.

(1-6) Economizer Heat Exchanger

The economizer heat exchanger 61 carries out heat exchange between high-pressure refrigerant flowing from the bridge circuit 55 to the expansion mechanism 70 and the receiver 80, and intermediate-pressure refrigerant from a part of that high pressure refrigerant that is branched off and expanded. A fifth outdoor electronic expansion valve 61*b* is provided in a pipe (injection pipe 61*a*) branched out from the main refrigerant pipe that flows refrigerant from the bridge circuit 55 to the expansion mechanism 70. This refrigerant, expanded when passing the fifth outdoor electronic expansion valve 61*b* and evaporated at the economizer heat exchanger 61, passes through the injection pipe 61*a* that extends towards the second intercooler pipe 42*a*, flows into a part of the second intercooler pipe 42*a* that is nearer to the third intake pipe 23*a* than the check valve, and cools refrigerant sucked from the third intake pipe 23*a* into the third compression part 23.

(1-7) Internal Heat Exchanger

The internal heat exchanger 62 performs heat exchange between high-pressure refrigerant flowing from the bridge circuit 55 to the expansion mechanism 70 and the receiver 80, and low-pressure gas refrigerant flowing by way of the expansion mechanism 70 and the like, is evaporated in the internal heat exchanger 12*a* or the outdoor heat exchanger 40 and flows in the low-pressure refrigerant pipe 19. The internal heat exchanger 62 can also be referred to as a liquid-gas heat exchanger. High-pressure refrigerant from the bridge circuit 55 first passes the economizer heat exchanger 61, then passes the internal heat exchanger 62 and flows towards the expansion mechanism 70 and the receiver 80.

(1-8) Expansion Mechanism

The expansion mechanism 70 depressurizes and expands high-pressure refrigerant flowing therein from the bridge circuit 55, and supplies intermediate-pressure refrigerant in a gas-liquid two-phase state to the receiver 80. That is, the expansion mechanism 70, in the cooling operation, depressurizes refrigerant delivered from the fourth heat exchanger 44 functioning as a gas cooler (radiator) of high-pressure refrigerant to the indoor heat exchanger 12*a* functioning as an evaporator of low-pressure refrigerant. In the heating operation, the expansion mechanism 70 depressurizes refrigerant delivered from the indoor heat exchanger 12*a* functioning as a gas cooler (radiator) of high-pressure refrigerant to the outdoor heat exchanger 40 functioning as an evaporator of low-pressure refrigerant. The expansion mechanism 70 is configured with an expander 71 and a sixth outdoor electronic expansion valve 72. The expander 71 performs the role of recovering throttling loss of the process of depressurising refrigerant as a valid work (energy).

(1-9) Receiver

The receiver 80 separates intermediate-pressure refrigerant in a gas-liquid two-phase state coming into the inner space thereof from the intake pipe 81 after being discharged from the expansion mechanism 70, into liquid refrigerant and gas refrigerant. The separated gas refrigerant passes through a seventh outdoor electronic expansion valve 91 disposed in a low-pressure return pipe 91*a*, becoming a low-pressure gas rich refrigerant which is then delivered to the super-cooling heat exchanger 90. The separated liquid refrigerant is delivered via the outlet pipe 82 to the super-cooling heat exchanger 90.

(1-10) Super-Cooling Heat Exchanger

The super-cooling heat exchanger 90 carries out heat exchange between low-pressure gas refrigerant and intermediate-pressure liquid refrigerant from the outlet pipe 82 of the receiver 80. A part of the intermediate-pressure liquid refrigerant coming from the outlet pipe 82 of the receiver 80, in the cooling operation, flows in a branch pipe 92*a* that branches from between the receiver 80 and the super-cooling heat exchanger 90, and passes through an eighth outdoor electronic expansion valve 92, becoming low-pressure refrigerant, in a gas-liquid two-phase state. The low-pressure refrigerant depressurized in the eighth outdoor electronic expansion valve 92 in the cooling operation, merges with low-pressure refrigerant depressurized in the seventh outdoor electronic expansion valve 91, being heat exchange, in the super-cooling heat exchanger 90, with intermediate-pressure liquid refrigerant flowing towards the bridge circuit 55 from the outlet pipe 82 of the receiver 80, and then in an overheated state, flows from the super-cooling heat exchanger 90 to the low-pressure refrigerant pipe 19 via the low-pressure return pipe 91*a*. On the other hand, intermediate-pressure liquid refrigerant flowing towards the bridge circuit 55 from the outlet pipe 82 of the receiver 80 is deprived of heat in the super-cooling heat exchanger 90, and flows to the bridge circuit 55 in a super-cooled state.

Furthermore, in the heating operation, the eighth outside electronic expansion valve 92 is closed, and refrigerant does not flow in the branch pipe 92*a*, however in the super-cooling heat exchanger 90, heat exchange is carried out between intermediate-pressure refrigerant coming from the outlet pipe 82 of the receiver 80 and low-pressure refrigerant depressurized in the seventh outdoor electronic expansion valve 91.

(1-11) Indoor Heat Exchanger

The indoor heat exchanger 12*a* is provided to each of the plurality of indoor units 12, and functions as an evaporator of refrigerant in the cooling operation and a cooler of refrigerant in the heating operation. Water or air is flowed through these indoor heat exchangers 12*a* as the cooling or heating medium for heat exchange with the refrigerant flowing inside. Here, indoor air from an indoor blower fan not shown in the drawing flows within the indoor heat exchanger 12*a*, and cooled or heated air-conditioning air is supplied indoors.

One end of the indoor heat exchanger 12*a* connects to the indoor electronic expansion valve 12*b* while the other end connects to the connecting refrigerant pipe 14.

(1-12) Indoor Electronic Expansion Valve

The indoor electronic expansion valves 12*b* are provided to each of the plurality of indoor units 12, to adjust the quantity of refrigerant flowing in the indoor heat exchanger 12*a* and to depressurize or expand the refrigerant. The indoor electronic expansion valve 12*b* is disposed between the connecting refrigerant pipe 13 and the indoor heat exchanger 12*a*.

(1-13) Control Part

Although not shown in the drawings, a control part is a microcomputer, which is connected to the compressor drive motor of the four-stage compressor 20, the first to fourth switching mechanisms 31-34 and each of the electronic expansion valves 12*b*, 51, 52, 61*b*, 72, 91 and 92. Based on an indoor set temperature input from an external source, this control part controls the number of rotations of the compressor drive motor, and switches between the cooling operation cycle and the heating operation cycle, adjusting the opening of the electronic expansion valves and the like.

(2) Operation of the Air-Conditioning Apparatus

Figure 2:
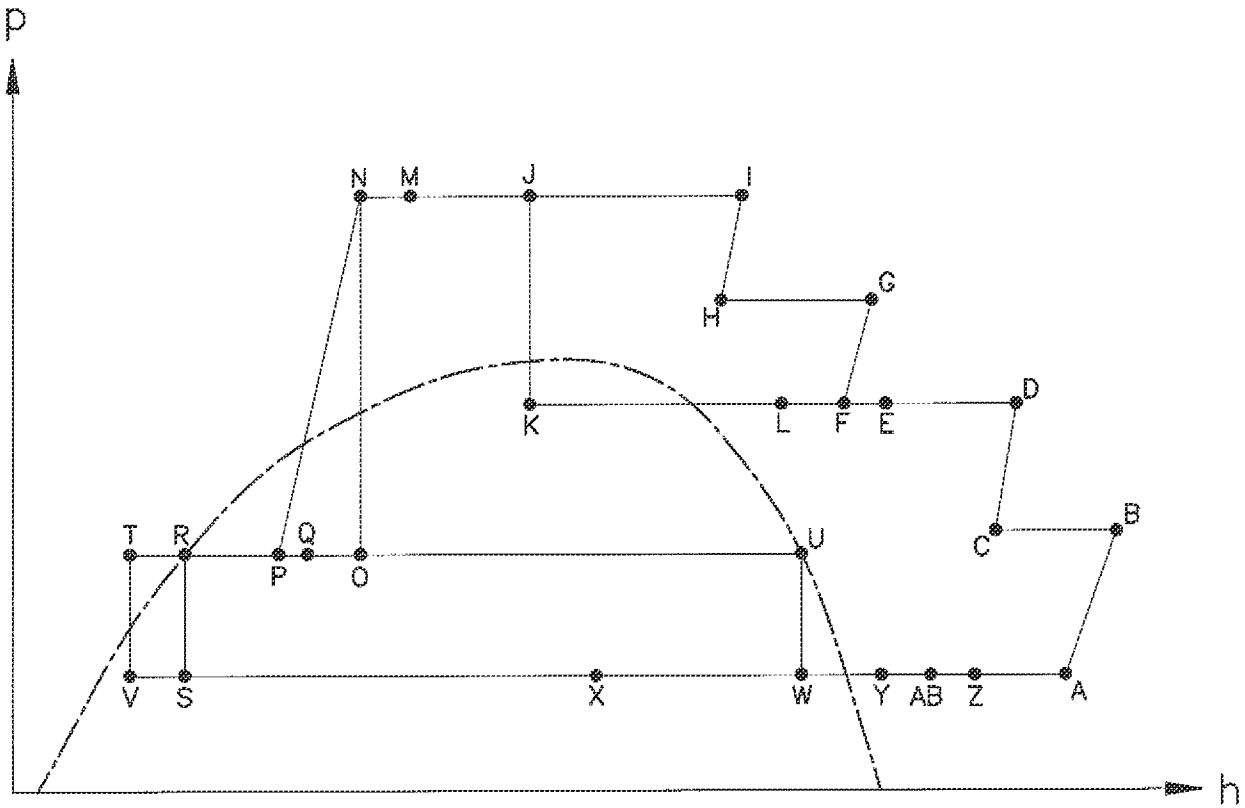
FIG. 2 is a pressure-enthalpy graph representing the refrigeration cycle during the cooling operation of FIG. 1.
Figure 4:
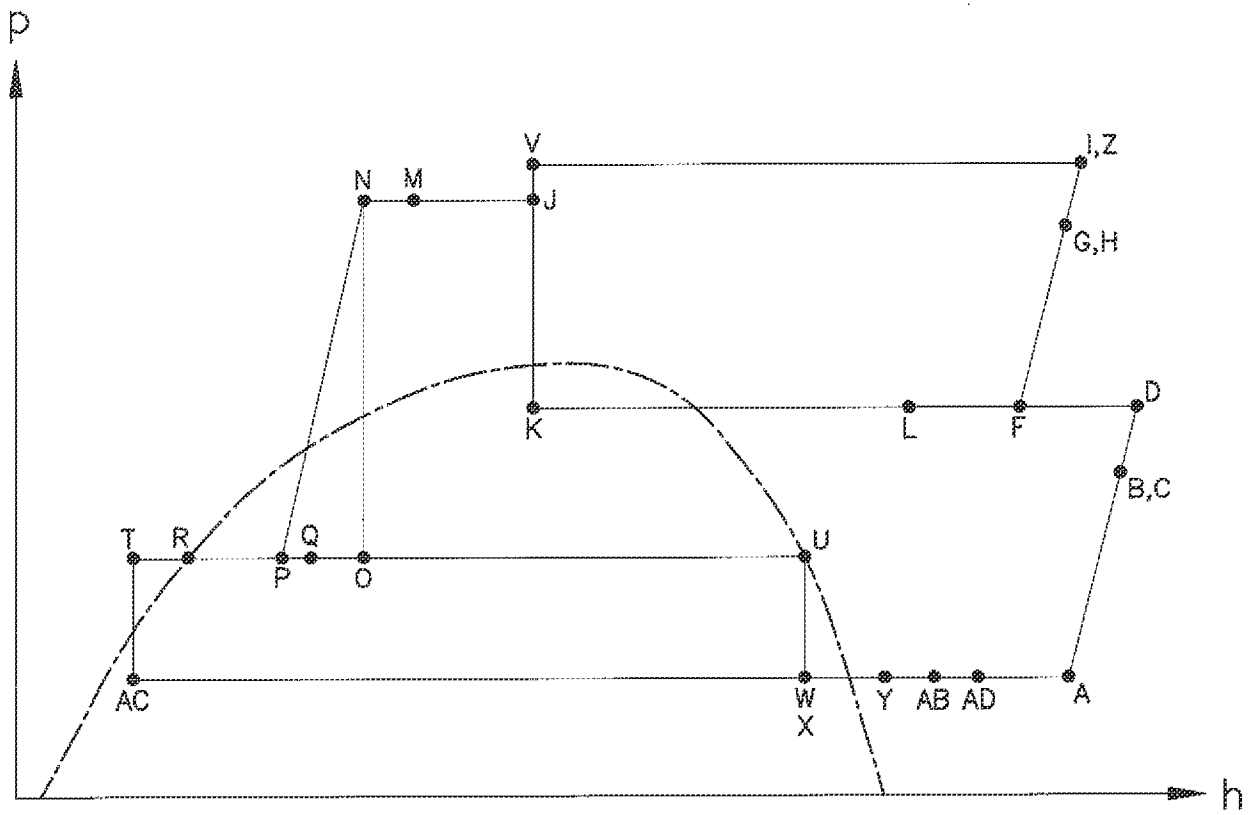
FIG. 4 is a pressure-enthalpy graph representing the refrigeration cycle during the heating operation of FIG. 3.

The operation of the air-conditioning apparatus 10 will now be described with reference to FIG. 1 through FIG. 4. FIG. 2 is a pressure-enthalpy graph (p-h diagram) representing the refrigeration cycle during the cooling operation. FIG. 4 is a pressure-enthalpy graph (p-h diagram) representing the refrigeration cycle during the heating operation. In FIGS. 2 and 4, the upwards bulging curve shown by the dot-dash line is a saturated liquid line of refrigerant and a dry saturated vapour line of refrigerant. In FIGS. 2 and 4, the points assigned alphabetic characters on the refrigeration cycle respectively represent the pressure of refrigerant and enthalpy at the points represented by the same alphabetic characters in FIGS. 1 and 3. For example, the refrigerant at point B in FIG. 1 has the pressure and enthalpy at point B in FIG. 2. Each operation control during the cooling operation and the heating operation of the air-conditioning apparatus 10 is performed by the control unit.

(2-1) Operation During the Cooling Operation

During the cooling operation, the refrigerant circulates inside the refrigerant circuit in the order of the four-stage compressor 20, the outdoor heat exchanger 40, the expansion mechanism 70, and the indoor heat exchanger 12*a*, in the direction of the arrows along the refrigerant pipes indicated in FIG. 1. The operation of the air-conditioning apparatus 10 during the cooling operation is described below while referring to FIGS. 1 and 2.

The low-pressure gas refrigerant sucked into the four-stage compressor 20 from the first intake pipe 21*a* (point A), is compressed in the first compression mechanism 21, and is blown out to the first blow-out pipe 21*b* (point B). This blown out refrigerant passes through the first switching mechanism 31 and after being cooled by the first heat exchanger 41 that functions as an intercooler, flows via the first intercooler pipe 41*a* into the second intake pipe 22*a* (point C).

The refrigerant sucked into the second compression part 22 from the second intake pipe 22*a* is compressed and blown out to the second blow-out pipe 22*b* (point D). This blown out refrigerant passes through the second switching mechanism 32 and after being cooled by the second heat exchanger 42 functioning as an intercooler, flows to the second intercooler pipe 42*a* (point E). The refrigerant flowing in the second intercooler pipe 42*a* merges with intermediate-pressure refrigerant (point L) that is heat exchanged in the economizer heat exchanger 61 and flows in the injection pipe 61*a*, thereafter flowing into the third intake pipe 23*a* (point F).

The refrigerant sucked into the third compression part 23 from the third intake pipe 23*a* is compressed and blown out to the third blow-out pipe 23*b* (point G). This blown out refrigerant then passes through the third switching mechanism 33 and after being cooled at the third heat exchanger 43 functioning as an intercooler, flows into the fourth intake pipe 24*a* via the third intercooler pipe 43*a* (point H).

The refrigerant sucked into the fourth compression part 24 from the fourth intake pipe 24*a* is compressed and blown out to the fourth blow-out pipe 24*b* (point I). This blown out high-pressure refrigerant passes through the fourth switching mechanism 34, and is then cooled at the fourth heat exchanger 44 functioning as a gas cooler, passing through the first outdoor electronic expansion valve 51 in the fully opened state and the check valve 55*a* of the bridge circuit 55, and flowing in to the economizer heat exchanger 61 (point J).

The high-pressure refrigerant passing through the check valve 55*a* of the bridge circuit 55, flows into the economizer heat exchanger 61, while a part of this refrigerant branches to flow to the fifth outdoor electronic expansion valve 61*b*. After being depressurized and expanded at the fifth outdoor electronic expansion valve 61*b*, the now intermediate-pressure refrigerant in a gas-liquid two-phase state (point K) is then subjected to heat exchange in the economizer heat exchanger 61 with high-pressure refrigerant flowing towards the internal heat exchanger 62 from the bridge circuit 55 (point J), becoming intermediate-pressure gas refrigerant (point L), that flows into the second intercooler pipe 42*a* by way of the injection pipe 61*a* as described above.

The high-pressure refrigerant (point M) coming out from the economizer heat exchanger 61 in a further temperature lowered state, after being subjected to heat exchange with intermediate-pressure refrigerant coming from the fifth outdoor electronic expansion valve 61*b*, then flows by way of the internal heat exchanger 62 to the expansion mechanism 70 (point N). In the internal heat exchanger 62, the refrigerant is subjected to heat exchange with low-pressure refrigerant flowing to the first intake pipe 21*a* of the four-stage compressor 20 from the low-pressure refrigerant pipe 19 as described subsequently, and the high-pressure refrigerant in the condition of point M becomes high-pressure refrigerant in the condition of point N, the temperature having been lowered.

The high-pressure refrigerant from out of the internal heat exchanger 62 (point N) is branched in two, the streams flowing through the expander 71 of the expansion mechanism 70 and the sixth outdoor electronic expansion valve 72 of the expansion mechanism 70 respectively. The intermediate-pressure refrigerant depressurized and expanded at the expander 71 (point P), and the intermediate-pressure refrigerant depressurized and expanded at the sixth outdoor electronic expansion valve 72 (point O), merge and then flow into the internal space of the receiver 80 from the intake pipe 81 (point Q). This intermediate-pressure refrigerant in a gas-liquid two-phase state flowed into the receiver 80, is separated in the internal space of the receiver 80 into liquid refrigerant and gas refrigerant.

The liquid refrigerant separated in the receiver 80 (point R) passes through the outlet pipe 82, and flows in that state to the super-cooling heat exchanger 90, while the gas refrigerant separated in the receiver 80 (point U) becomes low-pressure refrigerant after depressurization at the seventh outdoor electronic expansion valve 91 (point W) and flows to the super-cooling heat exchanger 90. Intermediate-pressure refrigerant flowing from the outlet pipe 82 of the receiver 80 towards the super-cooling heat exchanger 90, is branched out prior to the super-cooling heat exchanger 90, one stream passing through the super-cooling heat exchanger 90 and flowing towards the bridge circuit 55, the other flowing to the eighth outdoor electronic expansion valve 92 of the branch pipe 92*a*. Low-pressure refrigerant in a gas-liquid two-phase state depressurized after passing through the eighth outdoor electronic expansion valve 92 (point S) merges (point X) with the low-pressure refrigerant passing through the seventh outdoor electronic expansion valve 91 (point W), passes through the super-cooling heat exchanger 90 and flows to the low-pressure refrigerant pipe 19. Due to heat exchange in the super-cooling heat exchanger 90, the low-pressure refrigerant flowing towards the low-pressure refrigerant pipe 19 (point X) evaporates, and becomes overheated low-pressure refrigerant (point Y), and the intermediate-pressure refrigerant flowing towards the bridge circuit 55 (point R) is deprived heat, and becomes super-cooled intermediate-pressure refrigerant (point T).

The intermediate-pressure refrigerant in a super-cooled state after passing the super-cooling heat exchanger 90 (point T), passes through an outlet check valve 55*d* of the bridge circuit 55 and flows to the connecting refrigerant pipe 13. The refrigerant entering the indoor unit 12 from the connecting refrigerant pipe 13, is expanded when it passes through the indoor electronic expansion valve 12*b*, becoming gas-liquid two-phase low-pressure refrigerant (point V), and flows into the indoor heat exchanger 12*a*. In the indoor heat exchanger 12*a*, this low-pressure refrigerant obtains heat from air inside the chamber, becoming overheated low-pressure gas refrigerant (point Z). The low-pressure refrigerant coming out from the indoor unit 12 flows to the low-pressure refrigerant pipe 19 via the connecting refrigerant pipe 14 and the fourth switching mechanism 34 and flows.

The low-pressure refrigerant returning from the indoor unit 12 (point Z) and the low-pressure refrigerant flowing from the super-cooling heat exchanger 90 (point Y) merge in the low-pressure refrigerant pipe 19 (point AB), and return to the four-stage compressor 20 from the first intake pipe 21*a* passing through the internal heat exchanger 62. As described above, the low-pressure refrigerant flowing towards the four-stage compressor 20 (point AB) and the high-pressure refrigerant flowing from the bridge circuit 55 to the receiver 80 (point M) are subject to heat exchange in the internal heat exchanger 62.

The air-conditioning apparatus 10 performs the cooling operation cycle by circulating the refrigerant in the refrigerant circuit as described above.

(2-2) Operation During the Heating Operation

During the heating operation, the refrigerant circulates inside the refrigerant circuit in the order of the four-stage compressor 20, the indoor heat exchanger 12*a*, the expansion mechanism 70 and the outdoor heat exchanger 40, in the direction of the arrows along the refrigerant pipes indicated in FIG. 3. The operation of the air-conditioning apparatus 10 during the heating operation is described below while referring to FIGS. 3 and 4.

The low-pressure gas refrigerant sucked into the four-stage compressor 20 from the first intake pipe 21*a* (point A) is compressed at the first compression part 21 and blown out to the first blow-out pipe 21*b* (point B). This blown out refrigerant passes through the first switching mechanism 31 and flows into the second intake pipe 22*a* (point C).

The refrigerant sucked into the second compressor 22 from the second intake pipe 22*a* is compressed and blown out to the second blow-out pipe 22*b* (point D). This blown out refrigerant passes through the second switching mechanism 32 and flows to the third intake pipe 23*a*. Furthermore, in the third intake pipe 23*a*, the temperature of the refrigerant falls (point F) due to the inflow also of medium-pressure refrigerant subject to heat exchange in the economizer heat exchanger 61, flowing by way of the injection pipe 61*a* (point L).

The refrigerant sucked into the third compression part 23 from the third intake pipe 23*a* is compressed and blown out to the third blow-out pipe 23*b* (point G). This blown out refrigerant then passes through the third switching mechanism 33 and flows to the fourth intake pipe 24*a* (point H).

The refrigerant sucked into the fourth compression part 24 from the fourth intake pipe 24*a* is compressed and blown out to the fourth blow-out pipe 24*b* (point I). This high-pressure refrigerant blown out, then passes through the fourth switching mechanism 34, and flows to the indoor unit 12 via the connecting refrigerant pipe 14 (point Z).

The high-pressure refrigerant entering the indoor unit 12 from the connecting refrigerant pipe 14 releases heat in the internal space of the indoor heat exchanger 12*a* that functions as a cooler of refrigerant, warming the air inside the chamber. The high-pressure refrigerant with reduced temperature due to heat exchange at the indoor heat exchanger 12*a* (point V) is slightly depressurized when passing through the indoor electronic expansion valve 12*b*, then flows through the connecting refrigerant pipe 13 to the bridge circuit 55 of the outdoor unit 11, and flows towards the economizer heat exchanger 61 from an inlet check valve 55*b* (point J).

The high-pressure refrigerant from out of the bridge circuit 55 (point J) flows into the economizer heat exchanger 61, and a part of this refrigerant branches to flow to the fifth outdoor electronic expansion valve 61*b*. After being depressurized and expanded at the fifth outdoor electronic expansion valve 61*b*, the now intermediate-pressure refrigerant in a gas-liquid two-phase state (point K) is then subjected to heat exchange in the economizer heat exchanger 61 with high-pressure refrigerant flowing towards the internal heat exchanger 62 from the bridge circuit 55 (point J), becoming intermediate-pressure gas refrigerant (point L), that flows into the second intercooler pipe 42*a* by way of the injection pipe 61*a*.

The high-pressure refrigerant (point M) from out of the economizer heat exchanger 61 in a further temperature lowered state after being subjected to heat exchange with intermediate-pressure refrigerant coming from the fifth outdoor electronic expansion valve 61*b*, then flows through the internal heat exchanger 62 to the expansion mechanism 70 (point N). In the internal heat exchanger 62, the refrigerant is subjected to heat exchange with low-pressure refrigerant flowing to the first intake pipe 21*a* of the four-stage compressor 20 from the low-pressure refrigerant pipe 19 as described subsequently, and the high-pressure refrigerant in the condition of point M becomes high-pressure refrigerant in the condition of point N, the temperature having been lowered.

The high-pressure refrigerant out of the internal heat exchanger 62 (point N) is branched in two, the streams flowing through the expander 71 of the expansion mechanism 70 and the sixth outdoor electronic expansion valve 72 of the expansion mechanism 70 respectively. The intermediate-pressure refrigerant depressurized and expanded at the expander 71 (point P), and the intermediate-pressure refrigerant depressurized and expanded at the sixth outdoor electronic expansion valve 72 (point O), merge and then flow into the internal space of the receiver 80 from the intake pipe 81 (point Q). This intermediate-pressure refrigerant in a gas-liquid two-phase state flowed into the receiver 80, is separated in the internal space of the receiver 80 into liquid refrigerant and gas refrigerant.

The liquid refrigerant separated in the receiver 80 (point R) passes through the outlet pipe 82, and flows in that state to the super-cooling heat exchanger 90, while the gas refrigerant separated in the receiver 80 (point U) becomes low-pressure refrigerant after depressurization at the seventh outdoor electronic expansion valve 91 (point W) and flows to the super-cooling heat exchanger 90. Intermediate-pressure refrigerant flowing from the outlet pipe 82 of the receiver 80 towards the super-cooling heat exchanger 90, does not flow into the branch pipe 92*a* as the eighth outdoor electronic expansion valve 92 is closed, and the entire quantity thus flows into the super-cooling heat exchanger 90. In the super-cooling heat exchanger 90, heat exchange takes place between the intermediate-pressure refrigerant flowing from the outlet pipe 82 of the receiver 80 (point R) and the low-pressure refrigerant depressurized at the seventh outdoor electronic expansion valve 91 (points W, X). Resultantly, the low-pressure refrigerant flowing towards the low-pressure refrigerant pipe 19 (point X) evaporates and becomes overheated low-pressure refrigerant (point Y), and the intermediate-pressure refrigerant flowing towards the bridge circuit 55 from the receiver 80 (point R) is deprived, and becomes super-cooled intermediate-pressure refrigerant (point T).

The intermediate-pressure refrigerant passing through the outlet check valve 55*d* of the bridge circuit 55 after flowing out from the super-cooling heat exchanger 90, branches into two flows which are depressurized and expanded at the first and second outdoor electronic expansion valves 51 and 52 respectively, becoming gas-liquid two-phase low-pressure refrigerant (point AC). At this time, the degree to which the first and second outdoor electronic expansion valves open is adjusted in coordination with the pressure loss in the serially connected, first to third heat exchangers 41-43 and the pressure loss in the fourth heat exchanger 44, thereby suppressing uneven flow of refrigerant in either of these two flows.

The low-pressure refrigerant that flows into the fourth heat exchanger 44 of the outdoor heat exchanger 40 is evaporated taking heat from external air, and flows from the high-temperature-side pipe 44*h* of the fourth heat exchanger 44 to the low-pressure refrigerant pipe 19 via the fourth switching mechanism 34. On one hand, the low-pressure refrigerant that flows into the third heat exchanger 43 of the outdoor heat exchanger 40 then flows, in order, through the second heat exchanger 42 and the first heat exchanger 41, before entering the low-pressure refrigerant pipe 19 by way of the branch pipe 19*a* and merging with refrigerant exiting from the fourth heat exchanger 44. Specifically, the refrigerant out of the third heat exchanger 43 then travels, in order, through the high-temperature-side pipe 43*h* of the third heat exchanger 43, the third switching mechanism 33, the serial connection second pipe 42*b*, the low-temperature-side pipe 42*i* of the second heat exchanger 42, the second heat exchanger 42, the high-temperature-side pipe 42*h* of the second heat exchanger 42, the second switching mechanism 32, the serial connection first pipe 41*b*, the low-temperature-side pipe 41*i* of the first heat exchanger 41, the first heat exchanger 41, the high-temperature-side pipe 41*h* of the first heat exchanger 41 and the first switching mechanism 31. The refrigerant is then evaporated taking heat from external air in not only the third heat exchanger 43, but also the second heat exchanger 42 and the first heat exchanger 41 in that order, flowing from the branch pipe 19*a* into the low-pressure refrigerant pipe 19.

The low-pressure gas refrigerant evaporated to an overheated state in the fourth heat exchanger 44 and the serially connected first to third heat exchangers 41-43, merges in the low-pressure refrigerant pipe 19 to the downstream side of the outdoor heat exchanger 40 (point AD) as shown in FIG. 3, further merges (point AB) with low-pressure refrigerant flowing from the super-cooling heat exchanger 90 (point Y), then passes through the internal heat exchanger 62 and returns to the four-stage compressor 20 from the first intake pipe 21*a*. In the internal heat exchanger 62, low-pressure refrigerant flowing towards the four-stage compressor 20 (point AB) and high-pressure refrigerant flowing towards the receiver 80 from the bridge circuit 55 (point M) are subject to heat exchange, as described above.

The air-conditioning apparatus 10 performs the heating operation cycle by circulating the refrigerant in the refrigerant circuit as described above.

(3) Characteristics of the Air-Conditioning Apparatus (3-1)

In the air-conditioning apparatus 10 according to an embodiment of the present invention, during the heating operation, in order that the refrigerant flows in series through the three heat exchangers comprising the first to third heat exchangers 41-43, the refrigerant piping group connects the four-stage compressor 20, the switching mechanisms 31-34, the fourth heat exchanger 44, the first to third heat exchangers 41-43, and the expansion mechanism 70 and the indoor heat exchanger 12*a*.

Specifically, as shown in FIG. 3, during the heating operation, the first switching mechanism 31 connects the first blow-out pipe 21*b* and the second intake pipe 22*a*, and connects the high-temperature-side pipe 41*h* of the first heat exchanger 41 and the branch pipe 19*a* of the low-pressure refrigerant pipe 19. The second switching mechanism 32 connects the second blow-out pipe 22*b* with the third intake pipe 23*a*, and connects the high-temperature-side pipe 42*h* of the second heat exchanger 42 with the serial connection first pipe 41*b*. The third switching mechanism 33 connects the third blow-out pipe 23*b* and the fourth intake pipe 24*a*, and connects the high-temperature-side pipe 43*h* of the third heat exchanger 43 with the serial connection second pipe 42*b*. Moreover, the fourth switching mechanism 34 connects the fourth blow-out pipe 24*b* and the connecting refrigerant pipe 14, and connects the high-temperature-side pipe 44*h* of the fourth heat exchanger 44 with the low-pressure refrigerant pipe 19. In this way, the high-temperature-side pipe 43*h* of the third heat exchanger 43 is connected to the low-temperature-side pipe 42*i* of the second heat exchanger 42 via the third switching mechanism 33 and the serial connection second pipe 42*b*. Further, the high-temperature-side pipe 42*h* of the second heat exchanger 42 is connected to the low-temperature-side pipe 41*i* of the first heat exchanger 41 via the second switching mechanism 32 and the serial connection first pipe 41*b*. That is, the three heat exchangers comprising the third heat exchanger 43, the second heat exchanger 42 and the first heat exchanger 41 are connected in series.

Because the air-conditioning apparatus 10 is provided with a refrigerant circuit in which the refrigerant piping group is arranged in this way, during the heating operation, low-pressure refrigerant depressurized by the expansion mechanism 70 and the first and second outdoor electronic expansion valves 51, 52, flows through the fourth heat exchanger 44 and also flows through the serially connected first to third heat exchangers 41-43, the refrigerant being subject to evaporation in those four heat exchangers. That is, during the cooling operation, the first to third heat exchangers 41-43 function as respective intercoolers that cool refrigerant in the course of compression (intermediate-pressure refrigerant), while during the heating operation, these heat exchangers function as evaporators, serially connected. Adopting this configuration means that even in the case of the fourth heat exchanger 44 being designed with emphasis on performance in the cooling operation, the quantity of refrigerant flowing in the fourth heat exchanger 44 and the first to third heat exchangers 41-43 during the heating operation can be made to approach the appropriate value, and uneven flow of the refrigerant in the outdoor heat exchanger 40 can be suppressed.

(3-2)

In the air-conditioning apparatus 10, the outdoor heat exchanger 40 comprising an integrated structure including, arranged in order from bottom to top, the first heat exchanger 41, the second heat exchanger 42, the third heat exchanger 43, and the fourth heat exchanger 44, is housed in the outdoor unit 11 that is furnished with the upwards type blower fan 40*a*. For this reason, as described above, a relatively substantial quantity of air passes through the fourth heat exchanger 44 positioned above, while a relatively smaller quantity of air passes through the first through third heat exchangers 41-43 positioned below.

Further, as the outdoor heat exchanger 40 is designed with emphasis on performance during the cooling operation, the length of the path of the fourth heat exchanger 44 is considerably longer than the respective paths of the first through third heat exchangers 41-43. That is, in the fourth heat exchanger 44, pressure loss is higher than in the first to third heat exchangers 41-43 respectively.

Accordingly, assuming the case of employing a configuration in which the refrigerant flows through each of the first to fourth heat exchangers 41-44 in parallel during the heating operation, a condition would result in which there would be relatively depleted flow of refrigerant through the fourth heat exchanger 44, which receives substantial airflow, due to pressure loss being high, while a condition would result in which there would be substantial flow of refrigerant through the first to third heat exchangers 41-43, in which the quantity of airflow is relatively small. Thus the outdoor heat exchanger 40 would be incapable of functioning adequately as an evaporator.

However, in the air-conditioning apparatus 10, the first to fourth heat exchangers 41-44 are allocated into two arrangements, one being the fourth heat exchanger 44 and others being the serially connected first to third heat exchangers 41-43, thereby adopting a configuration in which, during the heating operation, low-pressure refrigerant flows in separate streams along these two channels, so that uneven flow of refrigerant in the outdoor heat exchanger 40 functioning as an evaporator can be suppressed, bringing improved operating efficiency during the heating operation.

(3-3)

In addition to utilizing the refrigerant piping group including the high-temperature-side pipe 41*h* of the first heat exchanger 41, the low-temperature-side pipe 41*i* of the first heat exchanger 41, the serial connection first pipe 41*b*, the high-temperature-side pipe 42*h* of the second heat exchanger 42, the low-temperature-side pipe 42*i* of the second heat exchanger 42, the serial connection second pipe 42*b* and the high-temperature-side pipe 43*h* of the third heat exchanger 43 during the cooling operation, the air-conditioning apparatus 10 also employs the second switching mechanism 32 and the third switching mechanism 33, connecting the first to third heat exchangers 41-43 in series.

In this way, by using the switching mechanisms 31-34 that switch to change the flow of refrigerant between the cooling operation and the heating operation, during the heating operation, each of the heat exchangers and the switching mechanisms are connected via the refrigerant piping group so that refrigerant flows in series through the first to third heat exchangers 41-43, thereby enabling the production costs of the air-conditioning apparatus 10 to be reduced.

(4) Modifications (4-1) Modification A

In the above-described embodiment, a refrigerant piping group is provided to the refrigerant circuit to facilitate connection in series, during the heating operation, of all of the first through third heat exchangers 41-43 that, during the cooling operation, function as intercoolers for cooling refrigerant in the course of compression (intermediate-pressure refrigerant). The present invention can, however, also employ the following modification.

Figure 6:
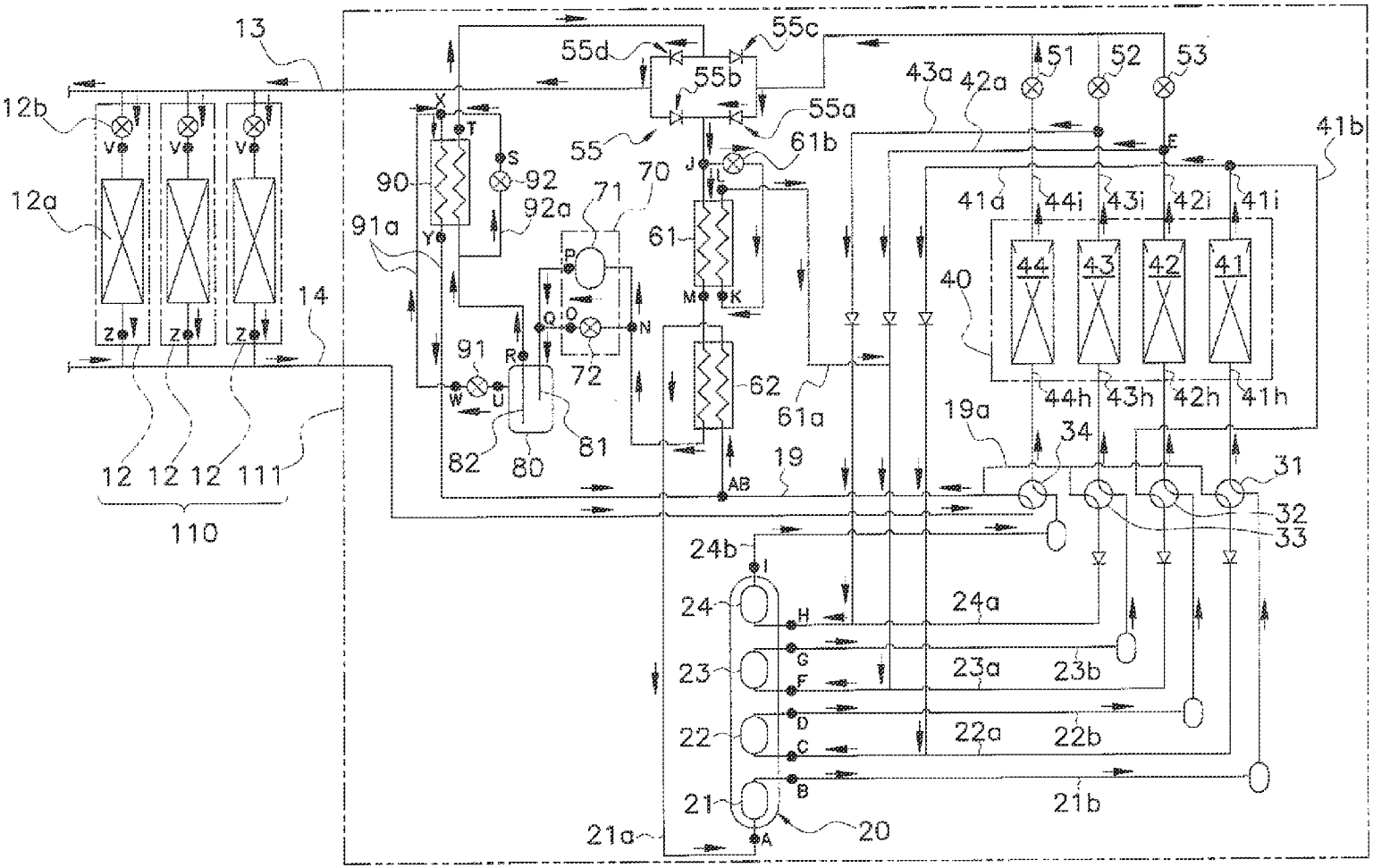
FIG. 6 is a schematic structural diagram showing the cooling operation of an air-conditioning apparatus according to Modification A.
Figure 7:
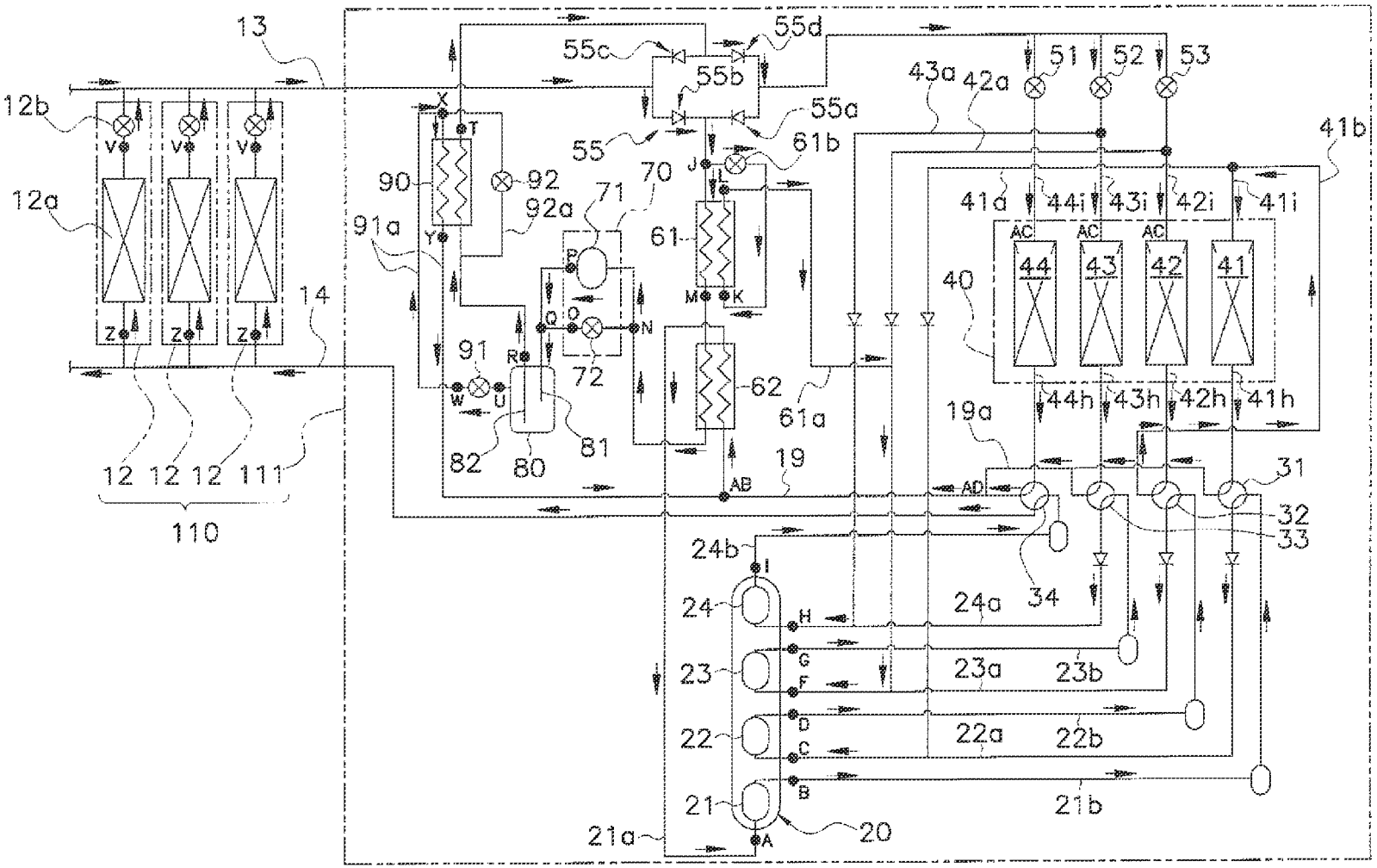
FIG. 7 is a schematic structural diagram showing the heating operation of the air-conditioning apparatus according to Modification A.

FIGS. 6 and 7 are schematic structural diagrams showing the refrigerant circuit of the air-conditioning apparatus 110 according to Modification A. FIG. 6 shows the flow of refrigerant circulating in the refrigerant circuit in the cooling operation. FIG. 7 shows the flow of refrigerant circulating in the refrigerant circuit in the heating operation. The outdoor unit 111 of the air-conditioning apparatus 110 dispenses with the serial connection second pipe 42*b* that is present in the configuration of the outdoor unit 11 in the above-described embodiment, and adds a third outdoor electronic compression valve 53, changing the flow of refrigerant in the outdoor heat exchanger 40 during the heating operation.

Here, the four ports of the third switching mechanism 33 connect to the third blow-out pipe 23*b*, the fourth intake pipe 24*a*, the high-temperature-side pipe 43*h* of the third heat exchanger 43, and the branch pipe 19*a* of the low-pressure refrigerant pipe 19. During the heating operation, intermediate-pressure refrigerant exiting from the super-cooling heat exchanger 90 (point Y) and flowing via the outlet check valve 55*d* of the bridge circuit 55, branches into three flows that are subject to depressurization and expansion in the first, second and third outdoor electronic expansion valves 51, 52, and 53 respectively, becoming low-pressure refrigerant in a gas-liquid two-phase state (point AC). The low-pressure refrigerant flowing into the fourth heat exchanger 44 of the outdoor heat exchanger 40 is evaporated taking heat from external air, then flows to the low-pressure refrigerant pipe 19 from the high-temperature-side pipe 44*h* via the fourth switching mechanism 34. The low-pressure refrigerant flowing into the third heat exchanger 43 of the outdoor heat exchanger 40 also is evaporated taking heat from external air, and flows from the high-temperature-side pipe 43*h* via the third switching mechanism 33, to enter the low-pressure refrigerant pipe 19 from the branch pipe 19*a*. On the other hand, the low-pressure refrigerant flowing into the second heat exchanger 42 of the outdoor heat exchanger 40, passes via the second switching mechanism 32 and the serial connection first pipe 41*b*, flowing to the first heat exchanger 41, and thereafter flows by way of the first switching mechanism 31 and the branch pipe 19*a* to the low-pressure refrigerant pipe 19, and merging with refrigerant from the fourth heat exchanger 44 and the third heat exchanger 43. Specifically, the refrigerant exiting the second heat exchanger 42 flows in order through, the high-temperature-side pipe 42*h* of the second heat exchanger 42, the second switching mechanism 32, the serial connection first pipe 41*b*, the low-temperature-side pipe 41*i* of the first heat exchanger 41, the first heat exchanger 41, the high-temperature-side pipe 41*h* of the first heat exchanger 41, and the first switching mechanism 31, being evaporated taking heat from external air in not only the second heat exchanger 42, but in the first heat exchanger 41 also, and flows through the branch pipe 19*a* to the low-pressure refrigerant pipe 19.

The low-pressure gas refrigerant of each of the three channels, evaporated and overheated at the fourth heat exchanger 44, the third heat exchanger 43, and the serially connected first and second heat exchangers 41 and 42, then merges in the branch pipe 19*a* and the low-pressure refrigerant pipe 19 (point AD) on the downstream side from the outdoor heat exchanger 40, as shown in FIG. 7.

The air-conditioning apparatus 110 according to the above described Modification A is particularly effective in the case in which the length of the paths of the fourth heat exchanger 44 and the third heat exchanger 43 is considerably longer than the lengths of the respective paths of the first and second heat exchangers 41 and 42. That is, in the case in which in comparison to the first and second heat exchangers 41 and 42, the third and fourth heat exchangers 43 and 44 have high pressure loss, having the low-pressure refrigerant of the three channels comprising the first and second heat exchangers 41 and 42, also the third heat exchanger 43, and the fourth heat exchanger 44 respectively flow in parallel, reduces the phenomenon of uneven flow of the low-pressure refrigerant in the outdoor heat exchanger 40, enabling the refrigerant flowing in each of those three channels to be adjusted to the appropriate quantity, within the scope of adjustment provided by the outdoor electronic expansion valves 51-53.

(4-2) Modification B

In the above described embodiment, the present invention was applied in an air-conditioning apparatus 10 in a configuration providing the four-stage compressor 20, and the outdoor heat exchanger 40 configured with four heat exchangers 41-44, however the present invention can also be applied in a refrigeration apparatus provided with a three-stage compressor, it being possible to use two heat-source-side heat exchangers that function as intercoolers to cool refrigerant in the course of compression during the cooling operation, as evaporators connected in series during the heating operation. In this case, the low-pressure refrigerant in the heating operation is branched into two flow channels consisting of the third heat exchanger that functions as a gas cooler for cooling high-pressure refrigerant during the cooling operation, and the two heat exchangers connected in series, and it is possible here to reduce the difference in pressure loss between the two channels.

Further, although not discussed here in detail, the present invention can also be applied in a refrigeration apparatus provided with a compressor of five stages or more.

(4-3) Modification C

In the above-described embodiment, a refrigerant piping group is provided to the refrigerant circuit that facilitates connection in series, during the heating operation, of all of the first to third heat exchangers 41-43 that function as intercoolers for cooling intermediate-pressure refrigerant in the course of compression during the cooling operation, however the following configuration can also be adopted for the present invention.

Figure 8:
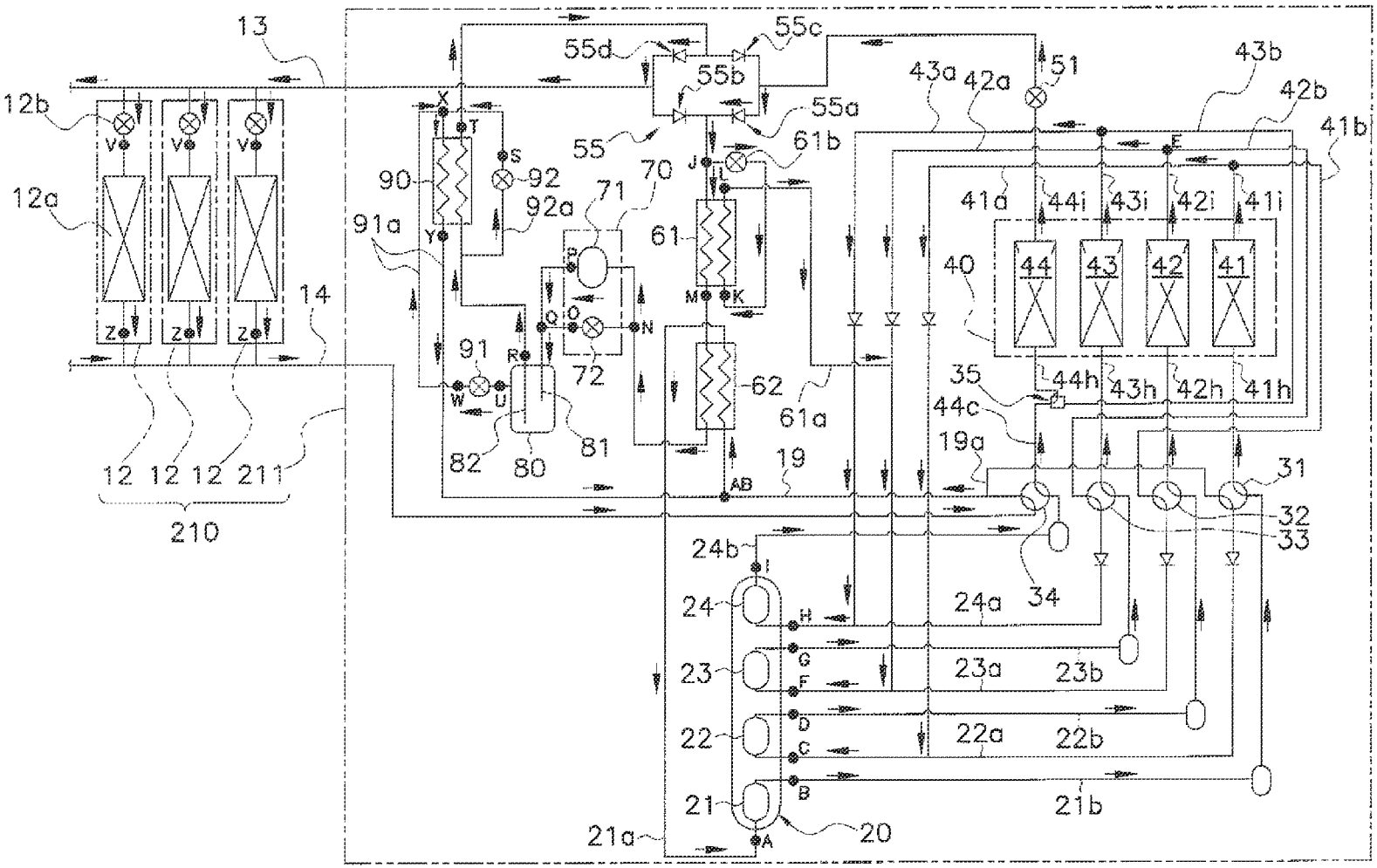
FIG. 8 is a schematic structural diagram showing the cooling operation of an air-conditioning apparatus according to Modification C.
Figure 9:
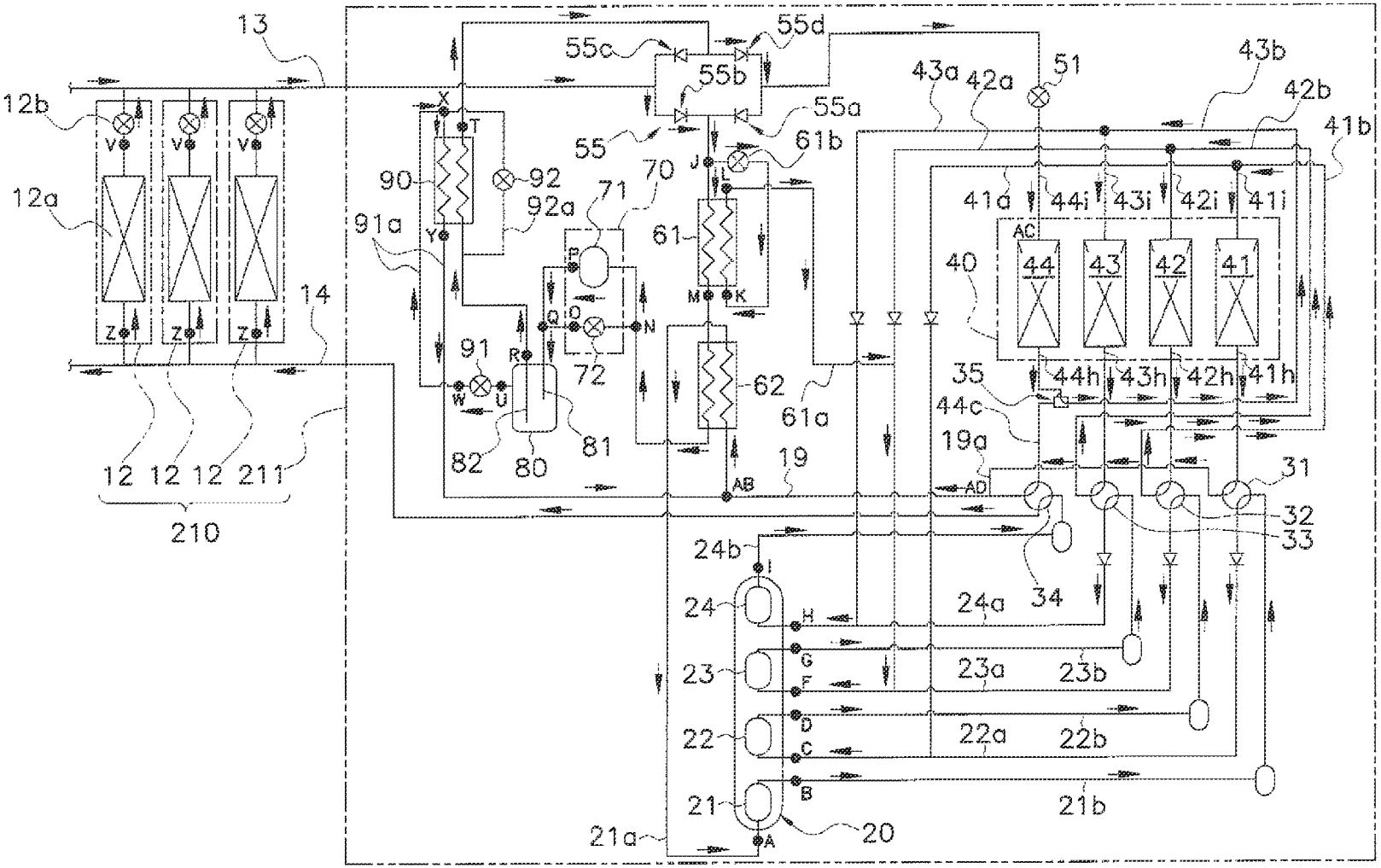
FIG. 9 is a schematic structural diagram showing the heating operation of the air-conditioning apparatus according to Modification C.

FIGS. 8 and 9 are schematic structural diagrams showing the refrigerant circuit of an air-conditioning apparatus 210 according to Modification C. FIG. 8 shows the flow of refrigerant circulating in the refrigerant circuit in the cooling operation, and FIG. 9 shows the flow of refrigerant circulating in the refrigerant circuit in the heating operation. The outdoor unit 211 of the air-conditioning apparatus 210 dispenses with the second outdoor electronic expansion valve 52 that is present in the configuration of the outdoor unit 11 in the above-described embodiment, and adds a serial connection third pipe 43*b* and a serial connection three-way valve 35, changing the flow of refrigerant in the outdoor heat exchanger 40 during the heating operation.

Here, the serial connection three-way valve 35 is disposed between the fourth switching mechanism 34 and the high-temperature-side pipe 44*h* of the fourth heat exchanger 44. The four ports of the fourth switching mechanism 34 connect to the fourth blow-out pipe 24*b*, the connecting refrigerant pipe 14, a connecting pipe 44*c* extending towards the serial connection three-way valve 35 and the low-pressure refrigerant pipe 19. The serial connection three-way valve 35 is a switching mechanism that switches between a first condition that communicates the fourth switching mechanism 34 via the connecting pipe 44*c* with the high-temperature-side pipe 44*h* of the fourth heat exchanger 44, and a second condition that communicates the high-temperature-side pipe 44*h* of the fourth heat exchanger 44 via the serial connection third pipe 43*b* with the low-temperature-side pipe 43*i* of the third heat exchanger 43. The serial connection three-way valve 35 switches to the first condition during the cooling operation and switches to the second condition during the heating operation (Refer FIGS. 8, 9).

In this air-conditioning apparatus 210 according to Modification C, during the cooling operation the flow of refrigerant is the same as that in the air-conditioning apparatus 10, however during the heating operation, the flow of refrigerant in the outdoor heat exchanger 40 changes. During the heating operation, intermediate-pressure refrigerant exiting the super-cooling heat exchanger 90 (point Y) and passing through the outlet check valve 55*d* of the bridge circuit 55 is not branched into separate flows, and is depressurized and expanded in the outdoor electronic expansion valve 51, becoming low-pressure refrigerant in a gas-liquid two-phase state (point AC). The low-pressure refrigerant flowing into the fourth heat exchanger 44 of the outdoor heat exchanger 40 then flows in order through the third heat exchanger 43, the second heat exchanger 42 and the first heat exchanger 41, flowing to the low-pressure refrigerant pipe 19 via the branch pipe 19*a*. Specifically, the refrigerant coming out from the fourth heat exchanger 44 then flows in order to the high-temperature-side pipe 44*h* of the fourth heat exchanger 44, the serial connection three-way valve 35, the serial connection third pipe 43*b*, the low-temperature-side pipe 43*i* of the third heat exchanger 43, the third heat exchanger 43, the high-temperature-side pipe 43*h* of the third heat exchanger 43, the third switching mechanism 33, the serial connection second pipe 42*b*, the low-temperature-side pipe 42*i* of the second heat exchanger 42, the second heat exchanger 42, the high-temperature-side pipe 42*h* of the second heat exchanger 42, the second switching mechanism 32, the serial connection first pipe 41*b*, the low-temperature-side pipe 41*i* of the first heat exchanger 41, the first heat exchanger 41, the high-temperature-side pipe 41*h* of the first heat exchanger 41, and the first switching mechanism 31, being evaporated taking heat from external air in not only the fourth heat exchanger 44 but in the third heat exchanger 43, the second heat exchanger 42 and the first heat exchanger 41 also, and then flowing through the branch pipe 19*a* to the low-pressure refrigerant pipe 19.

The low-pressure gas refrigerant evaporated and overheated by the fourth heat exchanger 44, the third heat exchanger 43, the second heat exchanger 42 and the first heat exchanger 41 connected in a line (point AD), merges (point AB) with low-pressure refrigerant flowing from the super-cooling heat exchanger 90 (point Y), then passes through the internal heat exchanger 62 and returns to the four-stage compressor 20 via the first intake pipe 21*a*.

The above described air-conditioning apparatus 210 according to Modification C is effective in the case in which, even when the outdoor heat exchanger 40 comprising the four heat exchangers 41-44 is used as an evaporator having a long single path during the heating operation, there is basically no problem of pressure loss in the outdoor heat exchanger 40. In the outdoor unit 211 of the air-conditioning apparatus 210, it is no longer necessary to branch the low-pressure refrigerant ahead the outdoor heat exchanger 40 functioning as an evaporator, consequently the problem of uneven flow of refrigerant does not arise.

(4-4) Modification D

In the above-described embodiment, a configuration is adopted in which during the heating operation, the first to fourth heat exchangers 41-44 are allocated into two arrangements, one being the fourth heat exchanger 44 and the other being the serially connected first to third heat exchangers 41-43, and the low-pressure refrigerant flows separately along these two channels, however it is also possible to allocate the channels differently. For example, a configuration can be adopted in which during the heating operation, the fourth heat exchanger 44 and the first heat exchanger 41 are connected in series, and the third heat exchanger 43 and the second heat exchanger 42 are connected in series so that the low-pressure refrigerant flows separately in these two channels.

(4-5) Modification E

In the above described embodiment, the present invention was applied in an air-conditioning apparatus 10 in a configuration providing the four-stage compressor 20, and the outdoor heat exchanger 40 configured with four heat exchangers 41-44, however the present invention can also be applied in a refrigeration apparatus provided with a two-stage compressor, it being possible to use the one heat exchanger on the heat-source-side that functions as an intercooler to cool refrigerant in the course of compression during the cooling operation, and the other heat exchanger that functions as a gas cooler cooling high-pressure refrigerant during the cooling operation, as evaporators connected in series during the heating operation.

Here, as the one heat exchanger on the heat-source-side and the other heat exchanger on the heat-source-side that both function as evaporators during the heating operation are connected in series, during that heating operation, and made the same refrigerant flowed, therefore even in the case of a design for two heat exchangers on the heat-source-side that emphasizes performance during the cooling operation, the phenomenon of uneven flow during the heating operation can be suppressed.

10, 110, 210 Air-conditioning apparatus (refrigeration apparatus)
12*a* Indoor heat exchanger (usage-side heat exchanger)
20 Four-stage compressor (multistage compression mechanism)
21 First compression part (low-stage compression part)
22 Second compression part (high-stage compression part; second stage compression part)
23 Third compression part (high-stage compression part; third stage compression part)
24 Fourth compression part (high-stage compression part; fourth stage compression part)
31 First switching mechanism
32 First switching mechanism
33 First switching mechanism
34 First switching mechanism
35 Serial connection three-way valve
40 Outdoor heat exchanger
41 First heat exchanger (heat-source-side first sub heat exchanger)
42 Second heat exchanger (heat-source-side second sub heat exchanger)
43 Third heat exchanger (heat-source-side third sub heat exchanger)
44 Fourth heat exchanger (heat-source-side main heat exchanger)
41*b* Serial connection first pipe
42*b* Serial connection second pipe
43*b* Serial connection third pipe
70 Expansion mechanism

CITATION LIST

Patent Literature

Patent Literature 1 (Japanese Laid-open Patent Application No. 2010-112618)

What is claimed is:

1. A refrigeration apparatus comprising:

a multistage compression mechanism in which one low-stage compression part and a plurality of high-stage compression parts are respectively connected in series;

a heat-source-side main heat exchanger that functions as a radiator during a cooling operation, and functions as an evaporator during a heating operation;

a plurality of heat-source-side sub heat exchangers that during the cooling operation, function as radiators that cool intermediate-pressure refrigerant in the course of compression that is taken into the high-stage compression parts, and during the heating operation, function as evaporators;

a usage-side heat exchanger that functions as an evaporator during the cooling operation and functions as a radiator during the heating operation;

switching mechanisms that change conditions so that during the cooling operation, the refrigerant is delivered from the heat-source-side main heat exchanger to the usage-side heat exchanger, and during the heating operation, the refrigerant is delivered from the usage-side heat exchanger to the heat-source-side main heat exchanger and the heat-source-side sub heat exchangers;

an expansion mechanism that during the cooling operation, depressurizes the refrigerant delivered from the heat-source-side main heat exchanger to the usage-side heat exchanger, and during the heating operation, depressurizes the refrigerant delivered from the usage-side heat exchanger to the heat-source-side main heat exchanger and the heat-source-side sub heat exchangers; and a refrigerant piping group connecting the multistage compression mechanism, the switching mechanisms, the heat-source-side main heat exchanger, the heat-source-side sub heat exchangers, the expansion mechanism and the usage-side heat exchanger so that during the heating operation, the refrigerant flows in series to not less than two of the heat-source-side sub heat exchangers of the plurality of heat-source-side sub heat exchangers.

2. The refrigeration apparatus according to claim 1, wherein the plurality of high-stage compression parts are a second stage compression part that takes in the refrigerant blown out from the low-stage compression part, a third stage compression part that takes in the refrigerant blown out from the second stage compression part, and a fourth stage compression part that takes in the refrigerant blown out from the third stage compression part and blows out the refrigerant to the radiator;

the plurality of heat-source-side sub heat exchangers are a heat-source-side first sub heat exchanger that during the cooling operation, cools the refrigerant blown out from the low-stage compression part and taken into the second stage compression part, a heat-source-side second sub heat exchanger that during the cooling operation, cools the refrigerant blown out from the second stage compression part and taken into the third stage compression part, and a heat-source-side third sub heat exchanger that during the cooling operation, cools the refrigerant blown out from the third stage compression part and taken into the fourth stage compression part; and during the heating operation the refrigerant flows in series to the heat-source-side first sub heat exchanger and the heat-source-side second sub heat exchanger, or flows in series to the heat-source-side first sub heat exchanger, the heat-source-side second sub heat exchanger and the heat-source-side third sub heat exchanger.

3. The refrigeration apparatus according to claim 2, wherein the plurality of heat-source-side sub heat exchangers in which the refrigerant flows in series during the heating operation are connected in series during the heating operation via the switching mechanisms.

4. The refrigeration apparatus according to claim 2, wherein during the heating operation, not less than two heat-source-side sub heat exchangers of the plurality of heat-source-side sub heat exchangers are connected in series with the heat-source-side main heat exchanger, and the refrigerant flows in series to not less than the two heat-source-side sub heat exchangers of the plurality of heat-source-side sub heat exchangers and the heat-source-side main heat exchanger.

5. The refrigeration apparatus according to claim 2, wherein during the heating operation, the refrigerant delivered from the usage-side heat exchanger via the expansion mechanism flows in parallel, the flow being distributed along three channels of the heat-source-side first sub heat exchanger and the heat-source-side second sub heat exchanger connected in series, the heat-source-side main heat exchanger, and the heat-source-side third sub heat exchanger.

6. The refrigeration apparatus according to claim 5, wherein the plurality of heat-source-side sub heat exchangers in which the refrigerant flows in series during the heating operation are connected in series during the heating operation via the switching mechanisms.

7. The refrigeration apparatus according to claim 5, wherein during the heating operation, not less than two heat-source-side sub heat exchangers of the plurality of heat-source-side sub heat exchangers are connected in series with the heat-source-side main heat exchanger, and the refrigerant flows in series to not less than the two heat-source-side sub heat exchangers of the plurality of heat-source-side sub heat exchangers and the heat-source-side main heat exchanger.

8. The refrigeration apparatus according to claim 1, wherein the plurality of heat-source-side sub heat exchangers in which the refrigerant flows in series during the heating operation are connected in series during the heating operation via the switching mechanisms.

9. The refrigeration apparatus according to claim 8, wherein during the heating operation, not less than two heat-source-side sub heat exchangers of the plurality of heat-source-side sub heat exchangers are connected in series with the heat-source-side main heat exchanger, and the refrigerant flows in series to not less than the two heat-source-side sub heat exchangers of the plurality of heat-source-side sub heat exchangers and the heat-source-side main heat exchanger.

10. The refrigeration apparatus according to claim 1, wherein during the heating operation, not less than two heat-source-side sub heat exchangers of the plurality of heat-source-side sub heat exchangers are connected in series with the heat-source-side main heat exchanger, and the refrigerant flows in series to not less than the two heat-source-side sub heat exchangers of the plurality of heat-source-side sub heat exchangers and the heat-source-side main heat exchanger.

11. A refrigeration apparatus comprising:

a multistage compression mechanism in which a low-stage compression part and a high-stage compression part are connected in series;

a heat-source-side main heat exchanger that functions as a radiator during a cooling operation, and functions as an evaporator during a heating operation;

a heat-source-side sub heat exchanger that during the cooling operation, functions as a radiator that cools intermediate-pressure refrigerant in the course of compression that is taken into the high-stage compression parts, and during the heating operation, functions as an evaporator;

a usage-side heat exchanger that functions as an evaporator during the cooling operation and functions as a radiator during the heating operation;

a switching mechanism that changes conditions so that during the cooling operation, the refrigerant is delivered from the heat-source-side main heat exchanger to the usage-side heat exchanger, and during the heating operation, the refrigerant is delivered from the usage-side heat exchanger to the heat-source-side main heat exchanger and the heat-source-side sub heat exchanger;

an expansion mechanism that during the cooling operation, depressurizes the refrigerant delivered from the heat-source-side main heat exchanger to the usage-side heat exchanger, and during the heating operation, depressurizes the refrigerant delivered from the usage-side heat exchanger to the heat-source-side main heat exchanger and the heat-source-side sub heat exchanger; and a refrigerant piping group connecting the multistage compression mechanism, the switching mechanism, the heat-source-side main heat exchanger, the heat-source-side sub heat exchanger, the expansion mechanism and the usage-side heat exchanger so that during the heating operation, the heat-source-side main heat exchanger and the heat-source-side sub heat exchanger are connected in series.

* * * * *